US006146823A

United States Patent [19]

Katoh

[11] Patent Number: 6,146,823

[45] Date of Patent: Nov. 14, 2000

[54] THERMOGRAPHIC IMAGE-RECORDING ELEMENT

[75] Inventor: Kazunobu Katoh, Kanagawa, Japan

[73] Assignee: Fuji Photo Film Co., LTD, Kanagawa, Japan

[21] Appl. No.: 09/272,552

[22] Filed: Mar. 19, 1999

[30] Foreign Application Priority Data

Apr. 8, 1998 [JP] Japan ..... 10-112722

[51] Int. Cl.[7] ..... G03C 1/498

[52] U.S. Cl. ..... 430/619; 430/531; 430/607; 430/617

[58] Field of Search ..... 430/617, 619, 430/531, 607, 264

[56] References Cited

U.S. PATENT DOCUMENTS

| | | | |
|---|---|---|---|
| 5,089,378 | 2/1992 | Ozaki et al. | 430/531 |
| 5,496,695 | 3/1996 | Simpson et al. . | |
| 5,545,515 | 8/1996 | Murray et al. . | |

*Primary Examiner*—Throl Chea
*Attorney, Agent, or Firm*—Birch, Stewart, Kolasch & Birch, LLP

[57] ABSTRACT

An acetylene compound is used in a thermographic image-recording element comprising on a support an image-recording layer containing a non-photosensitive organic silver salt, a reducing agent therefor, and a thermoplastic polymer binder. The element can be heat developed at lower temperatures.

9 Claims, No Drawings

THERMOGRAPHIC IMAGE-RECORDING ELEMENT

This invention relates to a thermographic or heat developable image-recording element.

BACKGROUND OF THE INVENTION

Photothermographic elements of the type wherein photographic images are formed through heat development are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic elements generally contain a reducible silver source (e.g., organic silver salt), a catalytic amount of a photocatalyst (e.g., silver halide), a reducing agent for silver, and a toner for controlling the tone of silver, typically dispersed in a binder matrix. Photothermographic elements are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

These photothermographic elements are widely used in the general photography, microphotography, medical image recording, graphic printing plate, and other fields. The light sources used in combination therewith have a wide range of wavelength including ultraviolet (UV), visible and near infrared light. With the recent advance of lasers and light-emitting diodes, the application of photothermographic elements wherein exposure is carried out at an oscillation wavelength from visible light to the near infrared region is increasing.

Also developed recently is a recording system using a thermal head which is simple and inexpensive as compared with the laser recording apparatus. The recording elements for this application are the same as the above-described thermographic recording elements except that photosensitive silver halide serving as the photocatalyst is omitted.

Regarding thermographic recording elements capable of forming high contrast images suitable for the graphic printing plate application, a number of patents are known. These patents disclose hydrazine derivatives, acrylonitrile derivatives, isoxazolone derivatives, tetrazolium derivatives, etc. as the contrast enhancer for producing high contrast images. For example, U.S. Pat. Nos. 5,464,738, 5,496,695, 5,512,411, 5,536,622, Japanese Patent Application Nos. 228627/1995, 215822/1996, 130842/1996, 148113/1996, 156378/1996, 148111/1996, and 148116/1996 describe hydrazine derivatives. Japanese Patent Application No. 83566/1996 describes compounds having quaternary nitrogen. U.S. Pat. No. 5,545,515 describes acrylonitriles. Illustrative examples of these compounds are Compounds 1 to 10 in U.S. Pat. No. 5,464,738, Compounds H-1 to H-28 in U.S. Pat. No. 5,496,695, Compounds I-1 to I-86 in JP Appln. No. 215822/1996, Compounds H-1 to H-62 in JP Appln. No. 130842/1996, Compounds I-1 to I-21 in JP Appln. No. 148113/1996, Compounds 1 to 50 in JP Appln. No. 148111/1996, Compounds 1 to 40 in JP Appln. No. 148116/1996, Compounds P-1 to P-26 and T-1 to T-18 in JP Appln. No. 83566/1996, and Compounds CN-1 to CN-13 in U.S. Pat. No. 5,545,515.

One of the serious problems associated with thermographic recording elements is a high developing temperature which can cause film deformation, blackened density variations, evolution of odorous or stimulative gases, and volatilization of acidic substances. The vapor acidic substances will stick to the surrounding electronic apparatus, causing corrosion. It is thus desired to lower the heat development temperature. Higher temperatures are required for heat development particularly when a water-dispersed polymer latex is used as the binder or when high contrast images are produced using ultrahigh contrast enhancers. In these cases, it is a very strong desire to lower the heat development temperature.

SUMMARY OF THE INVENTION

An object of the invention is to provide an improved thermographic image-recording element, and more particularly, a thermographic image-recording element which can be developed at lower temperatures.

Another object of the invention is to provide a thermographic image-recording element which can be developed at lower temperatures even when a thermoplastic polymer latex enabling environmentally and economically advantageous aqueous coating and ensuring satisfactory photographic performance is used as the binder in an image-recording layer or when ultrahigh contrast images are produced using ultrahigh contrast enhancers.

The invention provides a thermographic image-recording element comprising on a support an image-recording layer containing a non-photosensitive organic silver salt, a reducing agent capable of reducing the organic silver salt, and a thermoplastic polymer binder. The element further contains a compound of the following formula (I).

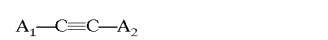

$$A_1—C\equiv C—A_2 \quad (I)$$

$A_1$ and $A_2$ may be the same or different and represent hydrogen, alkyl groups having up to 16 carbon atoms in total, or aromatic ring groups, at least one of $A_1$ and $A_2$ is an alkyl group of up to 16 carbon atoms in total having a hydroxyl group as a substituent, or an aryl group.

In one preferred embodiment, the thermographic image-recording element may further contain a photosensitive silver halide, an ultrahigh contrast promoting agent, and an antifoggant. With respect to the addition of these components, the binder is typically a water-dispersed latex of the thermoplastic polymer, and the reducing agent and the antifoggant are added as solid dispersions thereof in water.

DETAILED DESCRIPTION OF THE INVENTION

The thermographic or heat developable image-recording element of the invention has on a support an image-recording layer containing a non-photosensitive organic silver salt, a reducing agent capable of reducing the organic silver salt, and a thermoplastic polymer binder. Preferably the element further contains a photosensitive silver halide and/or an ultrahigh contrast promoting agent. By incorporating the compound of formula (I) in the thermographic image-recording element of this construction, the heat development temperature at which satisfactory photographic properties are accomplished can be lowered. This eliminates film deformation, blackened density variation and other troubles. The use of the compound of formula (I) is especially effective in embodiments wherein a water-dispersed latex of a thermoplastic polymer enabling environmentally and economically advantageous aqueous coating and ensuring satisfactory photographic performance is used as the binder in the image-recording layer or wherein an ultrahigh contrast promoting agent is contained in order to produce high contrast images, because higher heat development temperatures are otherwise required in these embodiments.

In the embodiment wherein a water-dispersed latex of a thermoplastic polymer is used as the binder in the image-recording layer, it is preferred that not only the non-photosensitive organic silver salt, but also the reducing agent and an antifoggant be added as solid dispersions. The addition of the compound of formula (I) during preparation of such solid dispersions in water has the auxiliary effect of promoting dispersion.

First, the compound of the formula (I) is described in detail.

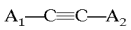

$$A_1—C\equiv C—A_2 \quad (I)$$

$A_1$ and $A_2$ may be the same or different and represent hydrogen, alkyl groups having up to 16 carbon atoms in total, or aromatic ring groups. At least one of $A_1$ and $A_2$ is an alkyl group of up to 16 carbon atoms in total having a hydroxyl group as a substituent, or an aryl group.

The alkyl groups of up to 16 carbon atoms in total represented by $A_1$ and $A_2$ may be normal or branched or cyclic. Preferably the total number of carbon atoms is 10 or less.

The aromatic ring groups include aryl groups such as phenyl and naphthyl and aromatic heterocyclic groups such as pyridyl, preferably aryl groups, and most preferably phenyl. Preferably the total number of carbon atoms is 1 to 16.

At least one of $A_1$ and $A_2$ is an alkyl group having a hydroxyl group as a substituent, or an aromatic ring group. The alkyl and aromatic ring groups may have hydroxyl groups, halogen atoms (F, Cl, Br and I), cyano groups, nitro groups, amino groups (which may be substituted with alkyl or hydroxyalkyl of up to 5 carbon atoms in total), alkoxy groups (of up to 5 carbon atoms in total) or hydroxyalkyl groups (of up to 5 carbon atoms in total) as the substituent. Other possible substituents on the alkyl groups are aryl groups such as phenyl, chlorophenyl, bromophenyl and cyanophenyl. Alkyl and other groups are also possible as substituents on the aromatic ring groups.

Preferably, $A_1$ and $A_2$ are alkyl groups.

Illustrative, non-limiting, examples of the compound of formula (I) are given below.

I-1

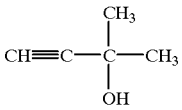

I-2

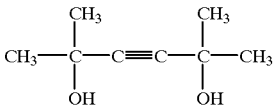

I-3

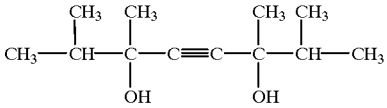

-continued

I-4

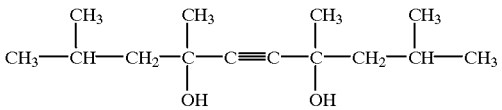

I-5

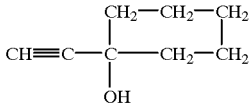

I-6

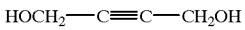

I-7

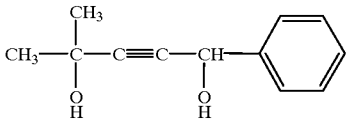

I-8

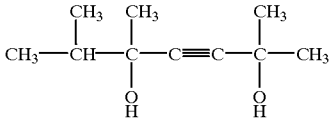

I-9

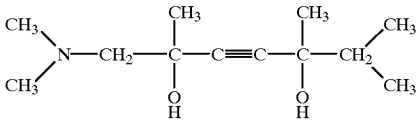

I-10

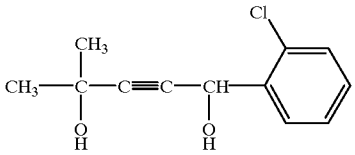

I-11

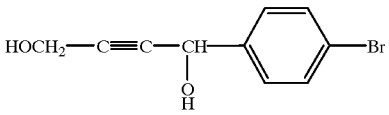

I-12

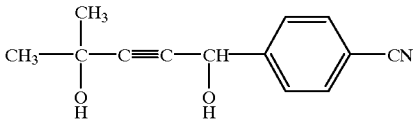

I-13

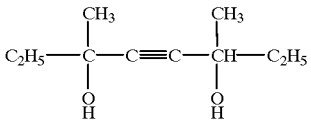

I-14

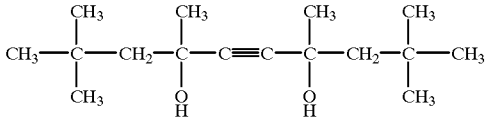

These compounds are known in the art. They are commercially available or synthesized by well-known methods.

On use, the compound of formula (I) is added to the image-recording layer or an auxiliary layer on the same side as the image-recording layer such as a subbing layer, antihalation layer, intermediate layer or protective layer. The compound is dissolved in water or organic solvents or the compound in solid state is mechanically dispersed before it is added to the desired layer. Preferably, the compound is added when a solid dispersion of a reducing agent or antifoggant is prepared. This improves productivity since two or more agents can be dispersed together, that is, only one dispersion step is required for two or more agents. Additionally, it has been unexpectedly ascertained that the compound of formula (I) is effective for promoting dispersion of the reducing agent or antifoggant by restraining bubbles from forming during the operation.

The compound of formula (I) is preferably used in an amount of 0.05 to 500 mg/m$^2$, more preferably 0.1 to 100 mg/m$^2$, as expressed by a coating weight per square meter of the recording element.

Reducing Agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of the image-recording layer. Where the reducing agent is added to a layer other than the emulsion layer in a multilayer construction, there is a tendency that a slightly greater amount of about 2 to 15% by weight is desirable.

For thermographic image-recording elements using organic silver salts, a wide range of reducing agents are disclosed. Exemplary reducing agents include amidoximes such as phenylamidoxime, 2-thienylamidoxime, and p-phenoxy-phenylamidoxime; azines such as 4-hydroxy-3,5-dimethoxy-benzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarbo-ethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

Especially preferred reducing agents are compounds having at least one phenolic hydroxyl group and substituted at the ortho-position with a substituent other than hydrogen. The compounds may contain one phenol ring or a plurality of phenol rings within the molecule.

Illustratively, compounds of the following formulae (Ia), (Ib), (IIa), (IIb), (III), (IVa), and (IVb) are preferable.

General formula (Ia)

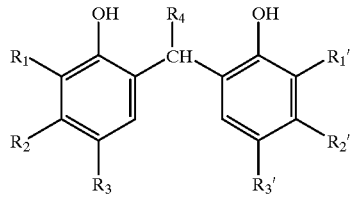

General formula (Ib)

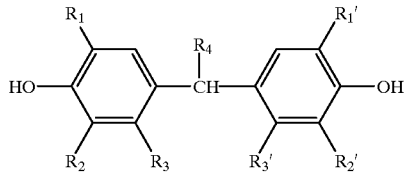

General formula (IIa)

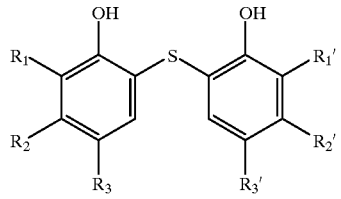

General formula (IIb)

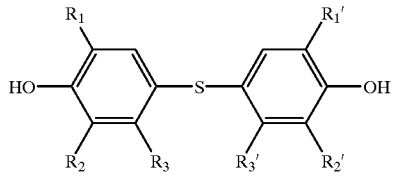

General formula (III)

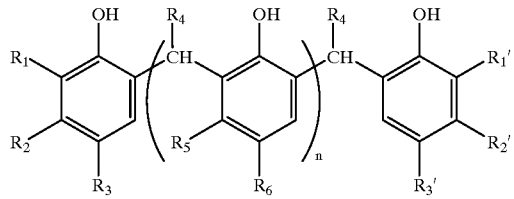

General formula (IVa)

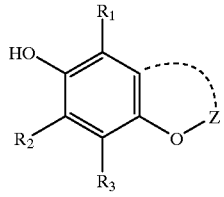

-continued

General formula (IVb)

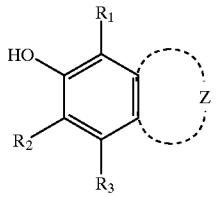

In formula (IVa), Z forms the ring shown below.

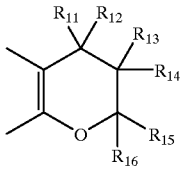

or

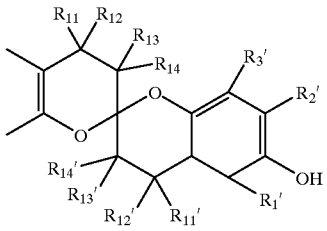

In formula (IVb), Z forms the ring shown below.

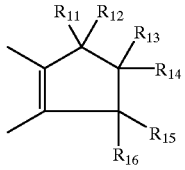

or

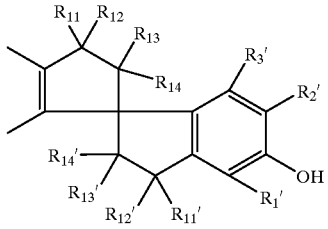

In the above formulae, substituents R's (including $R_1$ to $R_6$, $R_1'$ to $R_3'$, $R_{11}$ to $R_{16}$, and $R_{11}'$ to $R_{14}'$) represent hydrogen, alkyl of 1 to 30 carbon atoms, hydroxyl, alkoxy of 1 to 30 carbon atoms, aromatic (such as substituted or unsubstituted phenyl groups of up to 30 carbon atoms), aralkyl of up to 30 carbon atoms, halogen, and substituted or unsubstituted amino.

Illustrative examples are given below.

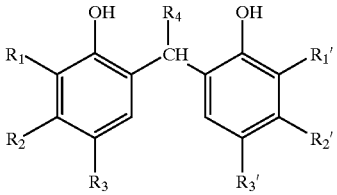

(Ia)

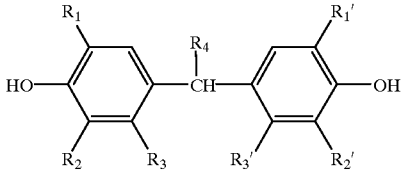

(Ib)

| | Skeleton | $R_1$, $R_1'$ | $R_2$, $R_2'$ | $R_3$, $R_3'$ | $R_4$ |
|---|---|---|---|---|---|
| Ia-1 | Ia | $CH_3$ | H | $CH_3$ | H |
| Ia-2 | | $CH_3$ | H | $CH_3$ | $C_9H_{19}$ |
| Ia-3 | | $CH_3$ | H | $CH_3$ | $C_7H_{15}$ |
| Ia-4 | | $CH_3$ | H | $CH_3$ | $C_3H_7$ |
| Ia-5 | | $CH_3$ | H | $CH_3$ | $CH_3$ |
| Ia-6 | | t-$C_4H_9$ | H | $C_2H_5$ | H |
| Ia-7 | | t-$C_4H_9$ | H | $CH_3$ | $C_3H_7$ |
| Ia-8 | | t-$C_4H_9$ | H | $CH_3$ | H |
| Ia-9 | | t-$C_4H_9$ | H | t-$C_4H_9$ | H |
| Ia-10 | | t-$C_4H_9$ | H | $CH_3$ | $C_7H_{15}$ |
| Ia-11 | | t-$C_4H_9$ | H | $CH_3$ | 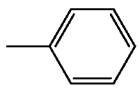 |
| Ia-12 | | $CH_3$ | H | $CH_3$ | $C_8H_{17}$ |
| Ib-13 | Ib | t-$C_4H_9$ | t-$C_4H_9$ | H | H |
| Ib-14 | | i-$C_4H_9$ | H | $CH_3$ | $C_3H_7$ |
| Ib-15 | | $CH_3$ | $CH_3$ | H | H |

-continued

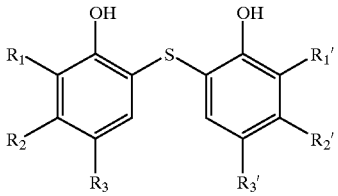

(IIa)

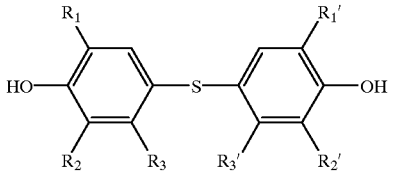

(IIb)

| | Skeleton | $R_1$, $R_1'$ | $R_2$, $R_2'$ | $R_3$, $R_3'$ |
|---|---|---|---|---|
| II-1 | IIa | t-$C_4H_9$ | H | $CH_3$ |
| II-2 | | $CH_3$ | H | $CH_3$ |
| II-3 | | $CH_3$ | H | $C_2H_5$ |
| II-4 | | iso-$C_3H_7$ | H | $CH_3$ |
| II-5 | | iso-$C_3H_7$ | H | $C_2H_5$ |
| II-6 | | $CH_3$ | H | t-$C_4H_9$ |
| II-7 | | $CH_3$ | H | iso-$C_3H_7$ |
| II-8 | | $CH_3$ | H | $C_2H_5$ |
| II-9 | IIb | t-$C_4H_9$ | H | $CH_3$ |
| II-10 | | t-$C_4H_9$ | $CH_3$ | H |
| II-11 | | t-$C_4H_9$ | H | $C_2H_5$ |
| II-12 | | t-$C_4H_9$ | $CH_3$ | $CH_3$ |
| II-13 | | $CH_3$ | $CH_3$ | H |
| II-14 | | iso-$C_3H_7$ | H | $CH_3$ |
| II-15 | | iso-$C_3H_7$ | iso-$C_3H_7$ | $CH_3$ |
| II-16 | | iso-$C_3H_7$ | iso-$C_3H_7$ | H |

(III)

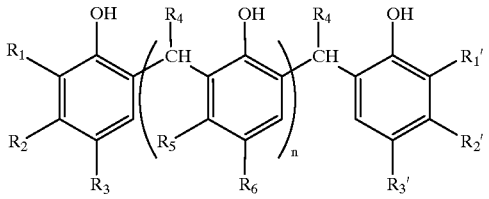

| | n | $R_1$,$R_1'$ | $R_2$, $R_2'$ | $R_3$, $R_3'$ | $R_4$ | $R_5$ | $R_6$ |
|---|---|---|---|---|---|---|---|
| III-1 | 1 | t-$C_4H_9$ | H | t-$C_4H_9$ | H | H | $CH_3$ |
| III-2 | 1 | $CH_3$ | H | $CH_3$ | H | H | $CH_3$ |
| III-3 | 1 | $CH_3$ | H | $C_2H_5$ | H | H | $C_2H_5$ |
| III-4 | 1 | iso-$C_3H_7$ | H | iso-$C_3H_7$ | H | H | $CH_3$ |
| III-5 | 2 | t-$C_4H_9$ | H | t-$C_4H_9$ | H | H | $CH_3$ |

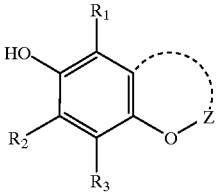

(IVa)

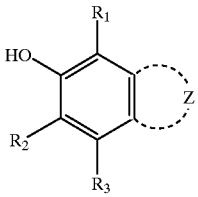

(IVb)

| | | Z | $R_1$ | $R_2$ | $R_3$ | $R_{11}$, $R_{12}$ | $R_{13}$, $R_{14}$ | $R_{15}$ | $R_{16}$ |
|---|---|---|---|---|---|---|---|---|---|
| IV-1 | IVa | 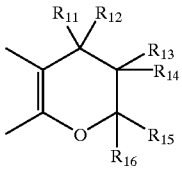 | $CH_3$ | $CH_3$ | $CH_3$ | H | H | $CH_3$ | $C_{16}H_{33}$ |
| IV-2 | | | $CH_3$ | $CH_3$ | $CH_3$ | H | H | $CH_3$ | $C_6H_{13}$ |
| IV-3 | | | $CH_3$ | $C_8H_{17}$ | H | $NCH_3$ | H | $CH_3$ | $CH_3$ |
| IV-4 | | | H | $C_8H_{17}$ | H | $NCH_3$ | H | $CH_3$ | $CH_3$ |
| IV-5 | | | H | H | $CH_3$ | H | H | $CH_3$ | $C_{16}H_{33}$ |
| IV-6 | | | H | $CH_3$ | H | $CH_3CH_3$ | H | $CH_3$ | $CH_3$ |
| IV-7 | | | H | $CH_3$ | H | $CH_3$ $CH_3$ | H | $CH_3$ | 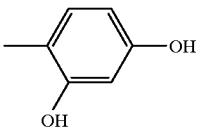 |

-continued

| | | $R_1$ $R_1'$ | $R_2$ $R_2'$ | $R_3$ $R_3'$ | $R_{11}$ $R_{12}$ | $R_{11}'$ $R_{12}'$ | $R_{13}$ $R_{14}$ | $R_{13}'$ $R_{14}'$ |
|---|---|---|---|---|---|---|---|---|
| IV-8 | | | | | | | | |
| IV-9 | | H | $CH_3$ | H | $CH_3$ | $CH_3$ | H | H |
| IV-10 | | $CH_3$ | $CH_3$ | $CH_3$ | H | H | H | H |
| IV-11 | | $CH_3$ | OH | $CH_3$ | $CH_3$ | $CH_3$ | H | H |
| IV-12 | | H | OH | $CH_3$ | $CH_3$ | $CH_3$ | H | H |
| | | $R_1$ | $R_2$ | $R_3$ | $R_{11}$ $R_{12}$ | $R_{13}$ $R_{14}$ | $R_{15}$ $R_{16}$ | |
| IV-13 | IVb | H | OH | $OH_3$ | $OH_3$ | H | H | |
| IV-14 | | $CH_3$ | $CH_3$ | $CH_3$ | $CH_3$ | H | H | |
| | | $R_1$ $R_1'$ | $R_2$ $R_2'$ | $R_3$ $R_3'$ | $R_{11}$ $R_{12}$ | $R_{13}R_{14}$ | | |
| IV-15 | | $CH_3$ | H | H | $R_{11}'$ $R_{12}'$ | $R_{13}'$ $R_{14}'$ | | |
| IV-16 | | $CH_3$ | $CH_3$ | H | $CH_3$ | H | | |
| IV-17 | | $CH_3$ | H | H | $CH_3$ | H | | |
| | | | | | $C_2H_5$ $CH_3$ | H | | |

An appropriate amount of the reducing agent used is $1\times10^{-2}$ to 10 mol, especially $1\times10^{-2}$ to 1.5 mol per mol of silver.

In the practice of the invention, the reducing agent and the ultrahigh contrast enhancer (to be described later) are preferably used in a molar ratio of from $1:10^{-3}$ to $1:10^{-1}$.

The thermographic image-recording element of the invention is to form photographic images through heat development. Such thermographic image-recording elements are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The thermographic image-recording element of the invention may be any of elements capable of forming photographic images through heat development although it preferably contains a reducible silver source (e.g., organic silver salt), a catalytic amount of a photocatalyst (e.g., silver halide), a reducing agent for silver, and a toner for controlling the tone of silver, typically dispersed in an organic binder matrix. Although the thermographic image-recording element is stable at room temperature, it is generally developed after exposure simply by heating at an elevated temperature and without a need for processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the reducible silver salt in exposed regions provides black images in contrast to unexposed regions, forming an image.

The thermographic image-recording element has at least one image-recording layer, preferably photosensitive layer on a support. Only the image-recording layer may be formed on the support although at least one non-image-recording layer is preferably formed on the image-recording layer.

One preferred embodiment of the invention is a photothermographic image-recording element. In this embodiment, in order to control the quantity or wavelength profile of light transmitted to the photosensitive layer, a filter layer may be formed on the same side of the support as the photosensitive layer or on the opposite side of the support. Alternatively, a dye or pigment may be incorporated in the photosensitive layer. The preferred dyes are described in Japanese Patent Application No. 11184/1995.

There may be provided a plurality of photosensitive layers. An arrangement of high/low or low/high sensitivity layers may be provided for gradation adjustment.

Various addenda may be added to the image-recording layer such as photosensitive layer, the non-image recording layer such as non-photosensitive layer, or other constituent layers. In the thermographic image-recording element of the invention, surfactants, antioxidants, stabilizers, plasticizers, UV absorbers, coating aids and other addenda may be used.

The binder used herein is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The addition of toners is very desirable. Examples of the preferred toners are described in *Research Disclosure* No. 17029 and include imides such as phthalimide; cyclic imides, pyrazolin-5-ones, quinazolinones, such as succinimide, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans such as 3-mercapto-1,2,4-triazole; N-(aminomethyl) aryldicarboxyimides such as N-(dimethylaminomethyl) phthalimide; a combination of blocked pyrazoles, isothiuronium derivatives and certain photo-bleach agents such as a combination of N,N'-hexamethylene(1-carbamoyl-3,5-dimethylpyrazole), 1,8-(3,6-dioxaoctane)bis(isothiuroniumtrifluoroacetate) and 2-(tribromomethylsulfonyl)-benzothiazole; merocyanine dyes such as 3-ethyl-5-{(3-ethyl-2-benzothiazolinylidene)-1-methylethylidene}-2-thio-2,4-oxazolidinedione; phthalazinone, phthalazinone derivatives or metal salts of the derivatives such as 4-(1-naphthyl)phthalazinone, 6-chlorophthalazinone, 5,7-dimethyloxyphthalazinone and 2,3-dihydro-1,4-phthalazinedione; a combination of phthlazinones and sulfinic acid derivatives such as 6-chlorophthalazinone plus sodium benzenesulfinate or 8-methylphthlazinone plus sodium p-trisulfonate; a combination of phthalazine and phthalic acid; a combination of phthalazines (inclusive of phthalazine adducts), maleic anhydride, and at least one selected from among phthalic acids, 2,3-naphthalene-carboxylic acids, o-phenylenic acid derivatives and anhydrides thereof (such as phthalic acid, 4-methylphthalic acid, 4-nitrophthalic acid, and tetrachlorophthalic anhydride); quinazolinedione, benzoxazine or naphthoxazine derivatives; benzoxazine-2,4-diones such as 1,3-benzoxazine-2,4-dione; pyrimidine and asym-triazines such as 2,4-dihydroxypyrimidine; and tetraazapentalene derivatives such as 3,6-dimercapto-1,4-diphenyl-1H,4H-2,3a,5,6a-tetra-azapentalene. Phthalazine is the preferred tone.

The silver halide used herein as a catalytic amount of photocatalyst may be any of photosensitive silver halides such as silver bromide, silver iodide, silver chloride, silver chlorobromide, silver iodobromide, and silver chloroiodobromide, with silver halides containing iodide ion being preferred. The silver halide may be added to the image-recording layer by any desired method, preferably such that the silver halide may be located in proximity to the reducible silver source. Usually the silver halide is contained in an amount of 0.75 to 30% by weight of the reducible silver source. The silver halide may be prepared by reacting a silver soap with a halide ion for halogen conversion of the soap moiety of the silver soap, or by preforming and adding during formation of a silver soap, or a combination thereof. The latter method is preferable. The photosensitive silver halide is described later in further detail.

The reducible silver sources are preferably silver salts of organic and hetero-organic acids containing reducible silver ion sources. More preferred are silver salts of long-chain aliphatic carboxylic acids of 10 to 30 carbon atoms, especially 15 to 25 carbon atoms. Also useful are organic or inorganic silver salt complexes in which the ligands have an overall stability constant of 4.0 to 10.0 relative to silver ion. Preferred examples of the silver salts are described in *Research Disclosure,* Nos. 17029 and 29963. Examples of the organic silver salt include silver salts of fatty acids (e.g., gallic acid, oxalic acid, behenic acid, stearic acid, palmitic acid, lauric acid, and arachic acid), silver salts of carboxyalkylthioureas (e.g., 1-(3-carboxypropyl)thiourea and 1-(3-carboxypropyl)-3,3-dimethylthiourea), silver complexes of polymeric reaction products of aldehydes (e.g., formaldehyde, acetaldehyde, and butylaldehyde) with hydroxy-substituted aromatic carboxylic acids (e.g., salicylic acid, bezoic acid, 3,5-dihydroxybenzoic acid, and 5,5-thiodisalicylic acid), silver salts or complexes of thioenes (e.g., 3-(2-carboxyethyl)-4-hydroxymethyl-4-thiazoline-2-thioene and 3-carboxymethyl-4-thiazoline-2-thioene), silver salts or complexes of nitrogenous acids (e.g., imidazole, pyrazole, urazole, 1,2,4-thiazole, 1H-tetrazole, 3-amino-5-benzylthio-1,2,4-triazole, and benzotriazole), a silver salt of saccharin, a silver salt of 5-chlorosalicylaldoxime, and silver salts of mercaptides. Silver behenate is most preferred. It is also preferable to use silver behenate with another organic acid silver. The amount of the reducible silver source used is preferably up to 5 g/m$^2$, preferably 0.3 to 3.0 g/m$^2$, calculated as the weight of silver coated per square meter of the recording element.

An antifoggant may be contained in the recording element. The most effective antifoggant was mercury ion. Use of a mercury compound as the antifoggant in photosensitive material is disclosed, for example, in U.S. Pat. No. 3,589,903. Mercury compounds, however, are undesirable from the ecological aspect. Preferred in this regard are non-mercury antifoggants as disclosed, for example, in U.S. Pat. Nos. 4,546,075 and 4,452,885 and JP-A 57234/1984.

Especially preferred non-mercury antifoggants are compounds as disclosed in U.S. Pat. Nos. 3,874,946 and 4,756,999 and heterocyclic compounds having at least one substituent represented by —C($X^1$)($X^2$)($X^3$) wherein $X^1$ and $X^2$ are halogen atoms such as F, Cl, Br, and I, and $X^3$ is hydrogen or halogen. Preferred examples of the antifoggant are shown below.

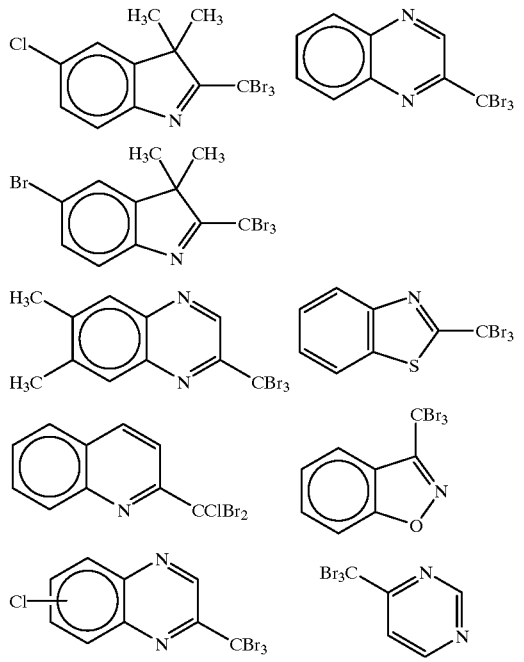

-continued

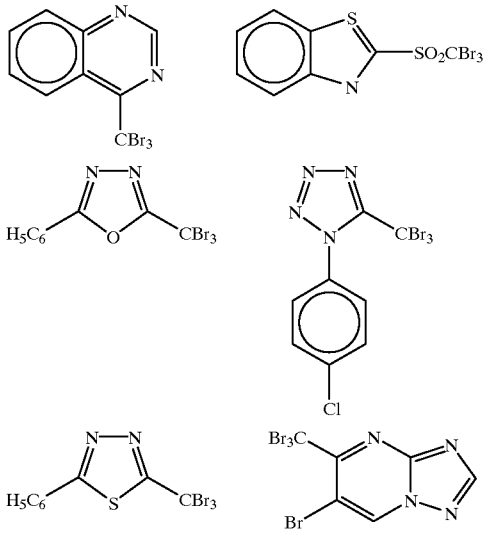

More preferred antifoggants are disclosed in U.S. Pat. No. 5,028,523, British Patent Application Nos. 92221383.4, 9300147.7 and 9311790.1.

In the thermographic image-recording element, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,455, 4,741,966, 4,751,175, and 4,835,096.

Useful sensitizing dyes which can be used herein are described in *Research Disclosure,* Item 17643 IV-A (December 1978, page 23), ibid., Item 1831 X (August 1978, page 437) and the references cited therein.

It is advantageous to select a sensitizing dye having appropriate spectral sensitivity to the spectral properties of a particular light source of various scanners. Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He—Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

For exposure of the thermographic image-recording element of the invention, an Ar laser (488 nm), He—Ne laser (633 nm), red semiconductor laser (670 nm), and infrared semiconductor laser (780 nm and 830 nm) are preferably used.

A dyestuff-containing layer may be included as an antihalation layer in the thermographic image-recording element of the invention. For Ar laser, He—Ne laser, and red semiconductor laser light sources, a dyestuff is preferably added so as to provide an absorbance of at least 0.3, more preferably at least 0.8 at an exposure wavelength in the range of 400 to 750 nm. For infrared semiconductor laser light sources, a dyestuff is preferably added so as to provide an absorbance of at least 0.3, more preferably at least 0.8 at an exposure wavelength in the range of 750 to 1500 nm. The dyestuffs may be used alone or in admixture of two or more. The dyestuff may be added to a dyestuff layer disposed on the same side as the photosensitive layer (serving as the image-recording layer) adjacent to the support or a dyestuff layer disposed on the support opposite to the photosensitive layer.

Mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone rings. These hetero-aromatic rings may have at least one substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer (serving as the image-recording layer) in amounts of 0.001 to 1.0 mol, more preferably 0.01 to 0.3 mol per mol of silver.

Silver Halide

A method for forming the photosensitive silver halide is well known in the art. Any of the methods disclosed in *Research Disclosure* No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller mean grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide as previously described. Silver bromide and silver iodobromide are preferable. Most recommended is silver iodobromide, preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-8}$ to $1\times10^{-4}$ mol per mol of silver.

Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

The amount of silver coated is preferably about 0.1 to 5 g per square meter of the recording element, more preferably about 0.3 to 3.0 $g/m^2$.

In one preferred embodiment, the thermographic image-recording element of the invention is a one-side recording element having at least one image-recording layer containing a silver halide emulsion on one side and a back (or backing) layer on the other side of the support.

To the back layer, antistatic agents such as conductive metal oxides and conductive polymers, matte agents for reducing a coefficient of friction, dyes for preventing halation, lubricants such as waxes, surfactants, crosslinking agents, and other agents may be added.

Examples of the conductive metal oxide particles include ZnO, $TiO_2$, $SnO_2$, $Al_2O_3$, $In_2O_3$, MgO, BaO, and $MoO_3$, and compound oxides thereof, which may contain a hetero atom. Preferred metal oxides are $SnO_2$, ZnO, $Al_2O_3$, $TiO_2$, $In_2O_3$, and MgO, more preferably $SnO_2$, ZnO, $In_2O_3$, and $TiO_2$, with $SnO_2$ being most preferred. Examples of the metal oxide containing a minor amount of a hetero atom are ZnO containing Al or In, $TiO_2$ containing Nb or Ta, $In_2O_3$ containing Sn, and $SnO_2$ containing Sb, Nb or halogen atom wherein the metal oxide is doped with 0.01 to 30 mol %, preferably 0.1 to 10 mol % of the hetero atom. Less than 0.01 mol % of the hetero atom would be too small to impart sufficient conductivity to oxide or compound oxide whereas more than 30 mol % of the hetero atom would increase the degree of blackening of particles so that the antistatic layer becomes blackened and unsuitable for the recording use. Accordingly, metal oxides and compound metal oxides containing a minor amount of hetero atom are preferred as the conductive metal oxide particles. They may have oxygen defects in their crystal structure. With respect to particle shape, acicular or fibrous particles are preferable to spherical particles.

Preferred as the conductive metal oxide particles containing a minor amount of hetero atom are $SnO_2$ particles doped with antimony, especially $SnO_2$ particles doped with 0.2 to 2.0 mol % of antimony.

In the practice of the invention, a matte agent may be added to the one-side recording element for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate (PMMA), polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

In one preferred embodiment of the invention, the matte agent is added to the back layer. The back layer should preferably have a degree of matte as expressed by a Bekk smoothness of 10 to 1200 seconds, more preferably 50 to 700 seconds.

In the practice of the invention, the matte agent is preferably added to an outermost surface layer on the recording element or a layer serving as the outermost surface layer or a layer near the outer surface, and also preferably to a layer serving as the so-called protective layer.

The binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of about 0.3 to 2 in the desired wavelength range, more preferably an absorbance of 0.5 to 2 in the IR range and an absorbance of 0.001 to less than 0.5 in the visible range. Further preferably, the back layer is an antihalation layer having an optical density of 0.001 to less than 0.3.

Where an anti-halation dye is used in the invention, it may be selected from various compounds insofar as it has the desired absorption in the wavelength range, is sufficiently low absorptive in the visible region after processing, and provides the back layer with the preferred absorbance profile. Exemplary antihalation dyes are given below though the dyes are not limited thereto. Useful dyes which are used alone are described in JP-A 13295/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column.

A backside resistive heating layer as described in U.S. Pat. Nos. 4,460,681 and 4,374,921 may be used in a photothermographic photographic imaging system according to the present invention.

In the recording element of the invention, a surface protective layer may be formed on the image-recording layer for anti-sticking or other purposes. In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the image-recording layer or a protective layer therefor, there may be used light absorbing substances and filter dyestuffs as described in U.S. Pat. Nos. 3,253,921, 2,274,782, 2,527,583, and 2,956,879. The dyestuffs may be mordanted as described in U.S. Pat. No. 3,282,699.

In the image-recording layer or a protective layer therefor, there may be used matte agents, for example, starch, titanium dioxide, zinc oxide, and silica as well as polymer beads including beads of the type described in U.S. Pat. Nos. 2,992,101 and 2,701,245. The emulsion layer side surface may have any degree of matte insofar as no star dust failures occur although a Bekk smoothness of 1,000 to 10,000 seconds, especially 2,000 to 10,000 seconds is preferred.

The image-recording layer is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

According to the invention, a thermoplastic polymer is an essential component of the binder. Preferably the thermoplastic polymer accounts for at least 50% by weight of the entire binder in the image-recording layer. The use of thermoplastic polymer as the major component ensures that the image-recording layer maintains its performance intact from its coating to heat development so that a satisfactory image is produced by heat development. Exemplary thermoplastic polymers used herein include polyvinyl alcohol, cellulose acetate butyrate, cellulose acetate propionate, styrene-butadiene copolymers, polyvinyl acetals (e.g., polyvinyl formal and polyvinyl butyral), polyurethanes, polyvinyl acetate, and acrylic resins (including acrylic rubber). These polymers have a weight average molecular weight (Mw) of about 1,000 to about 100,000.

The binder in the image-recording layer or other binder layers may also be selected from the binders described in JP-A 18542/1990, page 3, lower-right column, lines 1–20.

The thermographic recording element of the invention may be prepared by dispersing the organic acid silver and reducing agent in a water dispersion of the thermoplastic resin or polymer and applying the dispersion onto a support as described in Japanese Patent Application Nos. 13085/1996, 316985/1996, 13084/1996, and 316986/1996.

Preferably the image-recording layer is formed using a water-dispersed latex of the thermoplastic polymer. More preferably, the reducing agent and antifoggant are also solid-dispersed in water, and this dispersion added to the coating solution for the image-recording layer. Any of well-known methods may be employed to form solid dispersions. The dispersed particles preferably have a mean particle size of 0.01 to 10 $\mu$m, and more preferably particles with a size in the range of 0.1 to 5 $\mu$m are at least 90% by volume of the entire particles.

Contrast Enhancer

In order to produce ultrahigh contrast images, the thermographic image-recording element of the invention preferably contains ultrahigh contrast enhancers. The contrast enhancers which can be used herein are preferably selected from among substituted alkene derivatives, substituted isoxazole derivatives, and specific acetal compounds.

The substituted alkene derivatives, substituted isoxazole derivatives, and specific acetal compounds used herein are of the following formulas (1), (2), and (3), respectively.

(1)

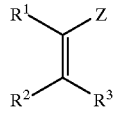

In formula (1), $R^1$, $R^2$, and $R^3$ are independently hydrogen or substituents, and Z is an electron attractive group or silyl group. At least one pair of ($R^1$ and Z), ($R^2$ and $R^3$), ($R^1$ and $R^2$), and ($R^3$ and Z), taken together, may form a cyclic structure.

(2)

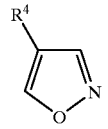

In formula (2), $R^4$ is a substituent.

(3)

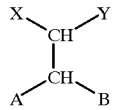

In formula (3), X and Y are independently hydrogen or substituents, A and B are independently alkoxy, alkylthio, alkylamino, aryloxy, arylthio, anilino, heterocyclic oxy, heterocyclic thio, or heterocyclic amino groups. X and Y, or A and B, taken together, may form a cyclic structure.

First, the substituted alkene derivatives of formula (1) are described in detail. In formula (1), $R^1$, $R^2$, and $R^3$ are independently hydrogen or substituents, and Z is an electron attractive group or silyl group. At least one pair of $R^1$ and Z, $R^2$ and $R^3$, $R^1$ and $R^2$, and $R^3$ and Z, taken together, may form a cyclic structure.

When $R^1$, $R^2$, and $R^3$ represent substituents, exemplary substituents include halogen atoms (e.g., fluorine, chlorine, bromine and iodine atoms), alkyl groups (including aralkyl, cycloalkyl and active methine groups), alkenyl groups, alkynyl groups, aryl groups, heterocyclic groups (inclusive of N-substituted nitrogenous heterocyclic groups), quaternized nitrogen atom-containing heterocyclic groups (such as pyridinio), acyl groups, alkoxycarbonyl groups, aryloxycarbonyl groups, carbamoyl groups, carboxy groups or salts thereof, imino groups, N-substituted imino groups, thiocarbonyl groups, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups or salts thereof, alkoxy groups (including groups containing recurring ethylenoxy or propylenoxy units), aryloxy groups, heterocyclic oxy groups, acyloxy groups, (alkoxy or aryloxy) carbonyloxy groups, carbamoyloxy groups, sulfonyloxy groups, amino groups, (alkyl, aryl or heterocyclic) amino groups, acylamino groups, sulfonamide groups, ureido groups, thioureido groups, imide groups, (alkoxy or aryloxy) carbonylamino groups, sulfamoylamino groups, semicarbazide groups, thiosemicarbazide groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, acylthio groups, (alkyl or aryl) sulfonyl groups, (alkyl or aryl) sulfinyl groups, sulfo groups or salts thereof, sulfamoyl groups, acylsulfamoyl groups, sulfonylsulfamoyl groups or salts thereof, phosphoryl groups, phosphoramide or phosphate structure-bearing groups, silyl groups, and stannyl groups. These substituents may be further replaced by other substituents selected from the foregoing examples.

In formula (1), Z is an electron attractive group or silyl group. The electron attractive group is a substituent whose Hammett substituent constant σp has a positive value. Exemplary electron attractive groups are cyano groups, alkoxycarbonyl groups, aryloxycarbonyl groups, carbamoyl groups, imino groups, N-substituted imino groups, thiocarbonyl groups, sulfamoyl groups, alkylsulfonyl groups, arylsulfonyl groups, nitro groups, halogen atoms, perfluoroalkyl groups, perfluoroalkaneamide groups, sulfonamide groups, acyl groups, formyl groups, phosphoryl groups, carboxy groups (or salts thereof), sulfo groups (or salts thereof), heterocyclic groups, alkenyl groups, alkynyl groups, acyloxy groups, acylthio groups, sulfonyloxy groups, and aryl groups having such electron attractive groups substituted thereon. The heterocyclic groups include saturated or unsaturated heterocyclic groups, for example, pyridyl, quinolyl, pyrazinyl, quinoxalinyl, benzotriazolyl, imidazolyl, benzimidazolyl, hydantoin-1-yl, succinimide and phthalimide groups.

The electron attractive group represented by Z in formula (1) may have a substituent or substituents which are selected from the same substituents that the substituents represented by $R^1$, $R^2$ and $R^3$ in formula (1) may have.

In formula (1), at least one pair of $R^1$ and Z, $R^2$ and $R^3$, $R^1$ and $R^2$, and $R^3$ and Z, taken together, may form a cyclic structure, which is a non-aromatic carbocyclic or non-aromatic heterocyclic one.

Described below is the preferred range of the compounds of formula (1). Preferred examples of the silyl group represented by Z in formula (1) include trimethylsilyl, t-butyldimethylsilyl, phenyldimethylsilyl, triethylsilyl, triisopropylsilyl, and trimethylsilyldimethylsilyl groups.

Preferred examples of the electron attractive group represented by Z in formula (1) include groups having 0 to 30 carbon atoms in total, for example, cyano, alkoxycarbonyl, aryloxycarbonyl, carbamoyl, thiocarbonyl, imino, N-substituted imino, sulfamoyl, alkylsulfonyl, arylsulfonyl, nitro, perfluoroalkyl, acyl, formyl, phosphoryl, acyloxy, and acylthio groups, and phenyl groups having an electron attractive group substituted thereon. More preferred examples include cyano, alkoxycarbonyl, carbamoyl, imino, sulfamoyl, alkylsulfonyl, arylsulfonyl, acyl, formyl, phosphoryl, and trifluoromethyl groups, and phenyl groups having an electron attractive group substituted thereon. Further preferred examples include cyano, formyl, acyl, alkoxycarbonyl, imino and carbamoyl groups.

The preferred groups represented by Z in formula (1) are electron attractive groups.

The substituents represented by $R^1$, $R^2$ and $R^3$ in formula (1) are preferably groups having 0 to 30 carbon atoms in total, for example, the same groups as the electron attractive groups represented by Z in formula (1), as well as alkyl, hydroxy (or salts thereof), mercapto (or salts thereof), alkoxy, aryloxy, heterocyclic oxy, alkylthio, arylthio, heterocyclic thio, amino, alkylamino, arylamino, heterocyclic amino, ureido, acylamino, sulfonamide, and substituted or unsubstituted aryl groups.

In formula (1), $R^1$ is preferably an electron attractive group, aryl group, alkylthio group, alkoxy group, acylamino group, hydrogen atom or silyl group.

When $R^1$ represents electron attractive groups, they are preferably groups of 0 to 30 carbon atoms, including cyano, nitro, acyl, formyl, alkoxycarbonyl, aryloxycarbonyl, thiocarbonyl, imino, N-substituted imino, alkylsulfonyl, arylsulfonyl, carbamoyl, sulfamoyl, trifluoromethyl, phosphoryl, carboxy (or salts thereof), and saturated or unsaturated heterocyclic groups; more preferably cyano, acyl, formyl, alkoxycarbonyl, carbamoyl, imino, N-substituted imino, sulfamoyl, carboxy (or salts thereof), and saturated or unsaturated heterocyclic groups; most preferably cyano, formyl, acyl, alkoxycarbonyl, carbamoyl, and saturated or unsaturated heterocyclic groups.

When $R^1$ represents aryl groups, they are preferably substituted or unsubstituted phenyl groups having 6 to 30 carbon atoms in total wherein the substituents, if any, are arbitrary although electron attractive substituents are preferred.

More preferably, $R^1$ in formula (1) is an electron attractive group or aryl group.

The substituents represented by $R^2$ and $R^3$ in formula (1) are preferably the same groups as the electron attractive groups represented by Z in formula (1), as well as alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino, and substituted or unsubstituted phenyl groups.

More preferably, one of $R^2$ and $R^3$ in formula (1) is hydrogen and the other is a substituent. In this case, preferred substituents are alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino (especially perfluoroalkaneamide), sulfonamide, substituted or unsubstituted phenyl and heterocyclic groups; more preferably hydroxy (or salts thereof), mercapto (or salts thereof), alkoxy, aryloxy, heterocyclic oxy, alkylthio, arylthio, heterocyclic thio and heterocyclic groups; and most preferably hydroxy (or salts thereof), alkoxy or heterocyclic groups.

It is also preferred that Z and $R^1$, or $R^2$ and $R^3$ in formula (1) form a cyclic structure together. The cyclic structures formed are non-aromatic carbocyclic or non-aromatic heterocyclic structures, preferably 5- to 7-membered cyclic structures having 1 to 40 carbon atoms, more preferably 3 to 30 carbon atoms in total inclusive of the carbon atoms in substituents.

Especially preferred of the compounds of formula (1) are those wherein Z is a cyano, formyl, acyl, alkoxycarbonyl, imino or carbamoyl group, $R^1$ is an electron withdrawing group or aryl group, one of $R^2$ and $R^3$ is hydrogen and the other is a hydroxy (or salts thereof), mercapto (or salts thereof), alkoxy, aryloxy, heterocyclic oxy, alkylthio, arylthio, heterocyclic thio or heterocyclic group. Also especially preferred of the compounds of formula (1) are those wherein Z and $R^1$ form a non-aromatic, 5- to 7-membered cyclic structure together, one of $R^2$ and $R^3$ is hydrogen and the other is a hydroxy (or salts thereof), mercapto (or salts thereof), alkoxy, aryloxy, heterocyclic oxy, alkylthio, arylthio, heterocyclic thio or heterocyclic group. In this case, Z which forms a non-aromatic cyclic structure with $R^1$ is preferably an acyl, carbamoyl, oxycarbonyl, thiocarbonyl or sulfonyl group while $R^1$ is preferably an acyl, carbamoyl, oxycarbonyl, thiocarbonyl, sulfonyl, imino, N-substituted imino, acylamino or carbonylthio group.

Secondly, the substituted isoxazole derivatives of formula (2) are described in detail. In formula (2), $R^4$ is a substituent. The definition and examples of the substituent represented by $R^4$ are the same as described for the substituents represented by $R^1$ to $R^3$ in formula (1).

In formula (2), the substituents represented by $R^4$ are preferably electron attractive groups or aryl groups. Preferred examples of the electron attractive groups include groups having 0 to 30 carbon atoms in total, such as cyano, nitro, acyl, formyl, alkoxycarbonyl, aryloxycarbonyl, alkylsulfonyl, arylsulfonyl, carbamoyl, sulfamoyl, trifluoromethyl, phosphoryl, imino, and saturated or unsaturated heterocyclic groups; more preferably cyano, acyl, formyl, alkoxycarbonyl, carbamoyl, sulfamoyl, alkylsulfonyl, arylsulfonyl, and heterocyclic groups; most preferably cyano, formyl, acyl, alkoxycarbonyl, carbamoyl, and heterocyclic groups.

When $R^4$ represents aryl, preferred aryl groups are substituted or unsubstituted phenyl groups having 6 to 30 carbon atoms in total. The substituents on the aryl groups are the same as described for the substituents represented by $R^1$ to $R^3$ in formula (1).

Preferably in formula (2), $R^4$ represents cyano, alkoxycarbonyl, carbamoyl, heterocyclic, or substituted or unsubstituted phenyl groups, and especially cyano, heterocyclic or alkoxycarbonyl groups.

Thirdly, the acetal compounds of formula (3) are described in detail. In formula (3), X and Y are independently hydrogen or substituents, A and B are independently alkoxy, alkylthio, alkylamino, aryloxy, arylthio, anilino, heterocyclic thio, heterocyclic oxy, or heterocyclic amino groups. X and Y, or A and B, taken together, may form a cyclic structure.

The substituents represented by X and Y are the same as described for the substituents represented by $R^1$ to $R^3$ in formula (1). Exemplary substituents are alkyl (inclusive of perfluoroalkyl and trichloromethyl), aryl, heterocyclic, halogen, cyano, nitro, alkenyl, alkynyl, acyl, formyl, alkoxycarbonyl, aryloxycarbonyl, imino, N-substituted imino, carbamoyl, thiocarbonyl, acyloxy, acylthio, acylamino, alkylsulfonyl, arylsulfonyl, sulfamoyl, phosphoryl, carboxy (or salts thereof), sulfo (or salts thereof), hydroxy (or salts thereof), mercapto (or salts thereof), alkoxy, aryloxy, heterocyclic oxy, alkylthio, arylthio, heterocyclic thio, amino, alkylamino, anilino, heterocyclic amino, and silyl groups. These groups may further have substituents. X and Y may bond together to form a cyclic structure, which may be either a non-aromatic carbocyclic or non-aromatic heterocyclic ring.

In formula (3), the substituents represented by X and Y are preferably groups having 1 to 40 carbon atoms in total, more preferably 1 to 30 carbon atoms in total, and include cyano, alkoxycarbonyl, aryloxycarbonyl, carbamoyl, imino, N-substituted imino, thiocarbonyl, sulfamoyl, alkylsulfonyl, arylsulfonyl, nitro, perfluoroalkyl, acyl, formyl, phosphoryl, acylamino, acyloxy, acylthio, heterocyclic, alkylthio, alkoxy, and aryl groups.

In formula (3), more preferred substituents represented by X and Y are cyano, nitro, alkoxycarbonyl, carbamoyl, acyl, formyl, acylthio, acylamino, thiocarbonyl, sulfamoyl, alkylsulfonyl, arylsulfonyl, imino, N-substituted imino, phosphoryl, trifluoromethyl, heterocyclic, and substituted phenyl groups. Especially preferred are cyano, alkoxycarbonyl, carbamoyl, alkylsulfonyl, arylsulfonyl, acyl, acylthio, acylamino, thiocarbonyl, formyl, imino, N-substituted imino, heterocyclic groups and phenyl groups having an electron attractive group substituted thereon.

It is also preferred that X and Y bond together to form a non-aromatic carbocyclic or non-aromatic heterocyclic ring. In this case, the cyclic structures are preferably 5- to 7-membered rings and have 1 to 40 carbon atoms, especially 3 to 30 carbon atoms in total. X and Y forming a cyclic structure are preferably acyl, carbamoyl, oxycarbonyl, thiocarbonyl, sulfonyl, imino, N-substituted imino, acylamino, and carbonylthio groups.

In formula (3), A and B are independently alkoxy, alkylthio, alkylamino, aryloxy, arylthio, anilino, heterocyclic thio, heterocyclic oxy or heterocyclic amino groups. A and B, taken together, may form a ring. The groups represented by A and B in formula (3) are preferably groups having 1 to 40 carbon atoms in total, more preferably 1 to 30 carbon atoms in total, and may further have substituents.

It is more preferred in formula (3) that A and B bond together to form a cyclic structure. In this case, the cyclic structures are preferably 5- to 7-membered non-aromatic heterocycles and have 1 to 40 carbon atoms, especially 3 to 30 carbon atoms in total. Examples of A bonded to B (that is, —A—B—) include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S—, and —N(Ph)—$(CH_2)_2$—S—.

The compounds of formulas (1), (2), and (3) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The compounds of formulas (1), (2), and (3) may have incorporated therein a ballast group or polymer commonly used in immobile photographic additives such as couplers. The incorporation of a ballast group is one of the preferred embodiments of the present invention. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The compounds of formulas (1), (2), and (3) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). The incorporation of groups containing recurring ethylenoxy or propylenoxy units or (alkyl, aryl or heterocyclic) thio groups is one of the preferred embodiments of the present invention. Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Illustrative examples of the compounds of formulas (1), (2), and (3) are given below although the invention is not limited thereto.

1
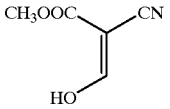
2
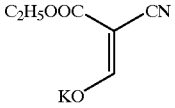
3
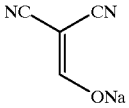
4
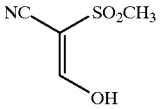
5
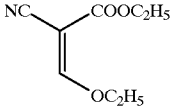
6
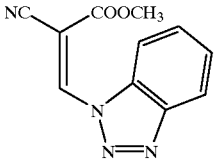
7
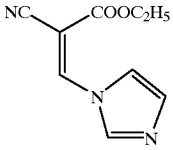
8
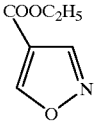
9
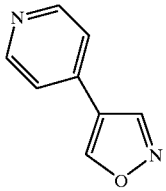
10
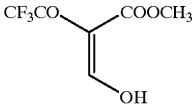
11
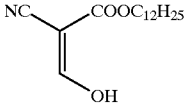
-continued
12
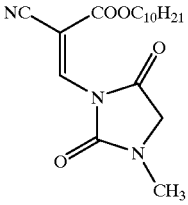
13
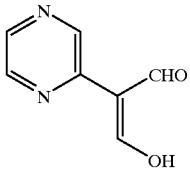
14
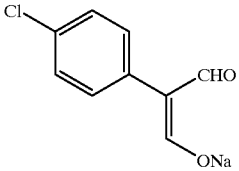
15
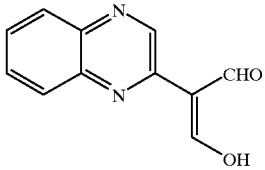
16
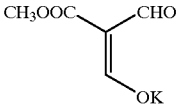
17
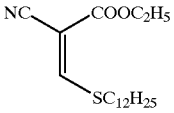
18
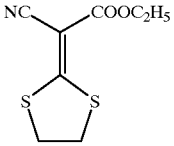
19
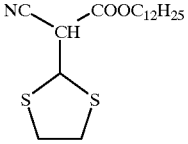

-continued
20
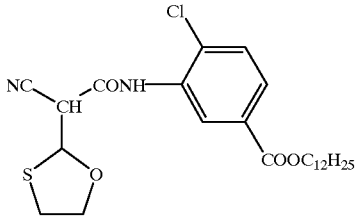
21
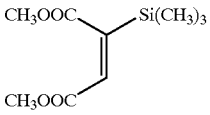
22
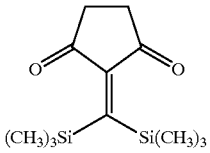
23
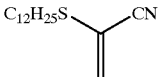
24
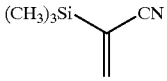
25
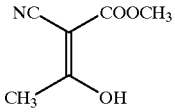
26
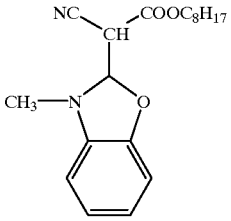
27
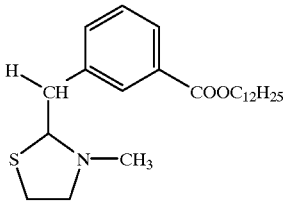
28
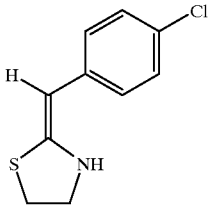
-continued
29
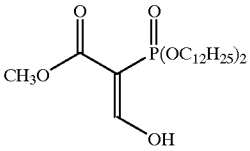
30
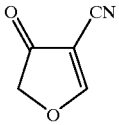
31
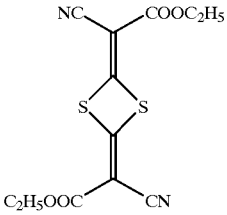
32
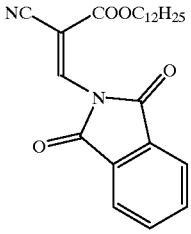
33
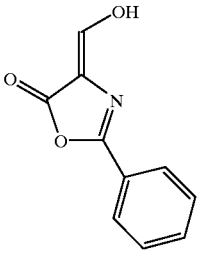
34
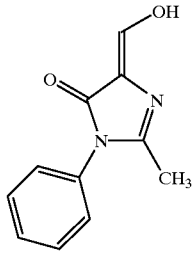
35
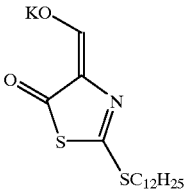

-continued
36
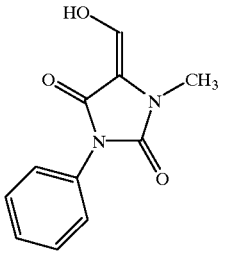
37
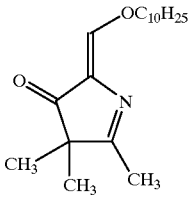
38
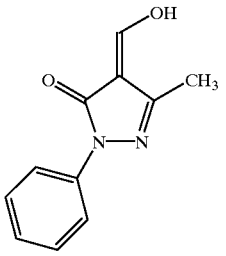
39
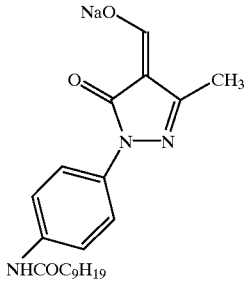
40
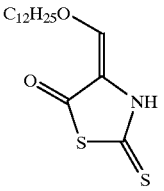
41
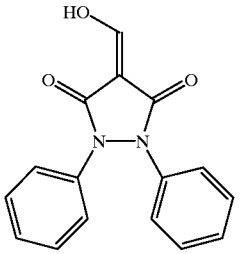
-continued
42
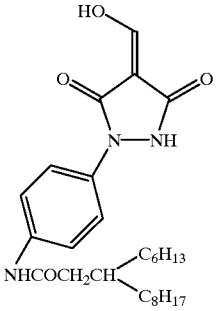
43
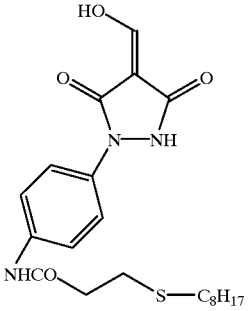
44
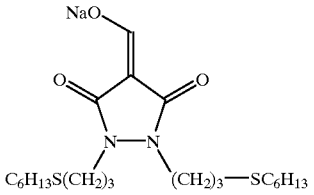
45
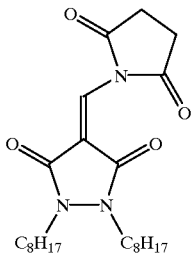
46
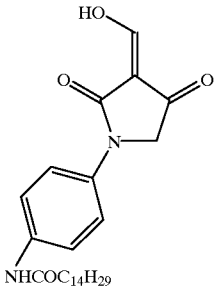

-continued
47
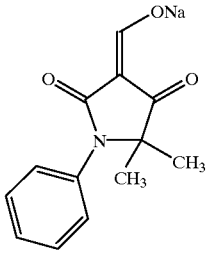
48
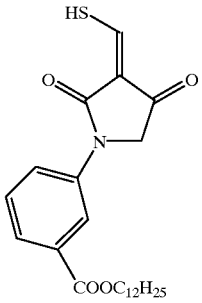
49
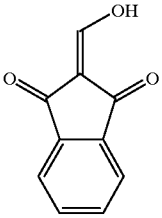
50
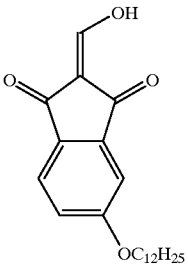
51
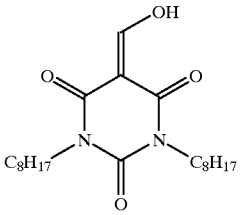
-continued
52
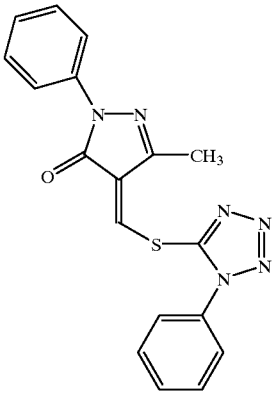
53
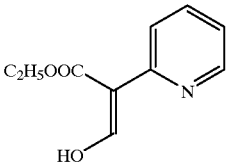
54
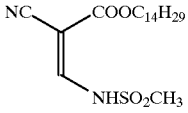
55
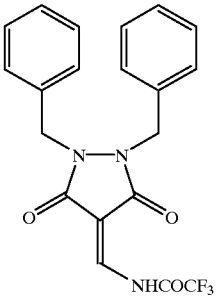
56
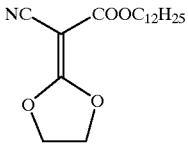
57
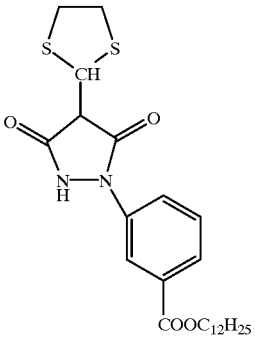

-continued

58

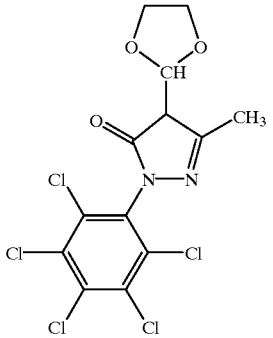

59

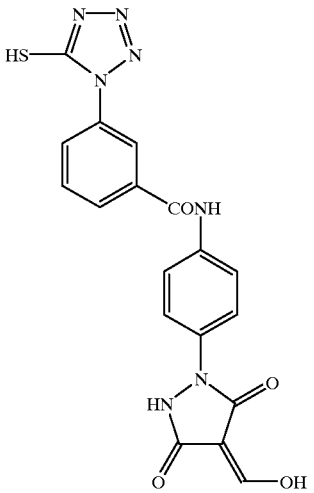

60

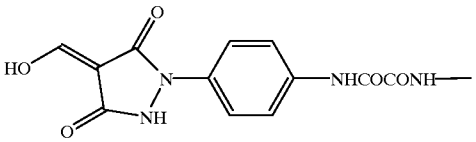

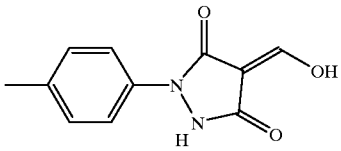

The compounds of formulas (1), (2), and (3) can be readily synthesized by well-known methods, for example, the methods described in U.S. Pat. Nos. 5,545,515, 5,635,339, and 5,654,130, WO 97/34196, and Japanese Patent Application Nos. 354107/1997, 309813/1997, and 272002/1997.

In the practice of the invention, the compound of formula (1) to (3) is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the compound of formula (1) to (3) with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the compound of formula (1) to (3) in powder form in a suitable solvent, typically water, in a ball mill, colloidal mill or ultrasonic mixer.

The compound of formula (1) to (3) may be added to a layer on the image-recording layer-bearing side of the support, that is, a image-recording layer or any other layer on that side of the support, and preferably to the image-recording layer or a layer disposed adjacent thereto.

The compound of formula (1) to (3) is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

The compounds of formulas (1) to (3) may be used alone or in admixture of two or more. In combination with the compounds of formulas (1) to (3), there may be used any of the compounds described in U.S. Pat. Nos. 5,545,515, 5,635,339, 5,654,130, and 5,686,228, WO 97/34196, and Japanese Patent Application Nos. 279962/1996, 228881/1997, 273935/1997, 354107/1997, 309813/1997, 296174/1997, 282564/1997, 272002/1997, 272003/1997, and 332388/1997.

Hydrazine derivatives can be used in combination. Such hydrazine derivatives are described in Japanese Patent Application Nos. 166628/1997, 279957/1996, and 240511/1997. Additionally, the following hydrazine derivatives are also useful. Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K. K., Mar. 22, 1991, pages 25–34 and Compounds D-2 and D-39 described in JP-A 86354/1987, pages 6–7.

In the practice of the invention, the hydrazine derivative is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine derivative may be added to a layer on the image-recording layer-bearing side of the support, that is, a image-recording layer or any other layer on that side of the support, and preferably to the image-recording layer or a layer disposed adjacent thereto.

The hydrazine derivative is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

Also in the practice of the invention, contrast promoting agents may be used in combination with the aforementioned nucleating agents or contrast enhancers for forming ultra-high contrast images. Such contrast promoting agents include the amine compounds described in U.S. Pat. No. 5,545,505, specifically Compounds AM-1 to AM-5 therein, the hydroxamic acids described in U.S. Pat. No. 5,545,507, specifically HA-1 to HA-11 therein, the acrylonitriles described in U.S. Pat. No. 5,545,507, specifically CN-1 to CN-13 therein, the hydrazine compounds described in U.S. Pat. No. 5,558,983, specifically CA-1 to CA-6 therein, the onium salts described in Japanese Patent Application No. 132836/1996, specifically A-1 to A-42, B-1 to B-27 and C-1 to C-14.

The synthesis methods, addition methods, and addition amounts of the aforementioned contrast enhancers and contrast promoting agents are as described in the above-listed patents.

Various supports are used in the invention. Useful supports are paper, synthetic paper, synthetic resin-laminated paper (exemplary synthetic resins being polyethylene, polypropylene and polystyrene), plastic films (e.g., polyethylene terephthalate, polycarbonate, polyimide, nylon, and cellulose triacetate), metal sheets (e.g., aluminum, aluminum alloys, zinc, iron and copper), paper sheets and plastic films having such metals laminated or evaporated thereon.

When plastic film is passed through a thermographic processor, the film experiences dimensional shrinkage or expansion. When the thermographic recording element is intended for printing purposes, this dimensional shrinkage or expansion gives rise to a serious problem against precision multi-color printing. Therefore, the invention favors the use of a film experiencing a minimal dimensional change. Exemplary materials are styrene polymers having a syndiotactic structure and heat-relaxation-treated polyethylene terephthalate. Also useful are materials having a high glass transition temperature, for example, polyether ethyl ketone, polystyrene, polysulfone, polyether sulfone, and polyarylate.

Heat treatment is often carried out on the support for relaxation. The supports to be heat treated are polymer films including polyesters (such as polyethylene terephthalate and polyethylene naphthalate), polycarbonates, polyether sulfones, polyarylates, and syndiotactic polystyrene. Of these, polyethylene terephthalate (PET) is most preferred.

Heat treatment is carried out on plastic films at any desired stage after their preparation and before coating of the image-recording layer. The steps taken in this duration include coating of an undercoat layer, coating of a back layer, and coating of an antihalation (AH) layer between the support and the image-recording layer. Heat treatment may be carried out on film films at various stages, before coating of an undercoat layer, after coating of an undercoating layer, after coating of a back layer, or after coating of an AH layer.

Heat treatment of the support is carried out at a temperature higher than the Tg of a polymer of which the support is made. Although the temperature varies with the material of the support, heat treatment is usually carried out at a temperature of 80 to 200° C., preferably 100 to 180° C., more preferably 110 to 160° C. Heat treatment may be carried out at a fixed temperature within this range or while raising or lowering the temperature within this range. Preferably heat treatment is carried out at a fixed temperature or while lowering the temperature. The heat treatment time is from 1 minute to 200 hours. Less than 1 minute of heat treatment is ineffective. With more than 200 hours, no further effect is obtained, the support can be colored or embrittled, and manufacturing efficiency is aggravated.

Heat treatment may be done on the support in roll form or while feeding the support in web form. Heat treatment of the support in roll form may be either of (1) a cold winding method of placing a roll at room temperature in a constant temperature tank and (2) a hot winding method of heating a web at a predetermined temperature while feeding it, and taking up the web in a roll form. Method (1) requires a time for heating and cooling, but a less investment for installation. Method (2) requires a winding device at high temperature, but a short heating time.

Heat treatment in roll form often invites surface failures such as creases by roll tightening and transfer of winding core section due to thermal shrinkage stresses generated during heat treatment. It is desirable to take a measure for preventing the transfer of winding core section by knurling opposite edges of a support to slightly raise only the edges. The knurled area preferably has a width of 2 to 50 mm, more preferably 5 to 30 mm, most preferably 7 to 20 mm and a height of 0.5 to 100 $\mu$m, more preferably 1 to 50 $\mu$m, most preferably 2 to 20 $\mu$m. Knurling may be done from one side or from both sides and preferably at a temperature above Tg. The atmosphere under which heat treatment is done should preferably have an absolute humidity corresponding to a water content of up to 22 grams, more preferably up to 16 grams, most preferably up to 8 grams per kg of air from the standpoint of blocking during heat treatment. No lower limit is imposed on the absolute humidity although the lower limit is usually a water content of about 0.1 gram per kg of air.

The roll is preferably wound under tension per unit width at an initial (leading edge) tension of 3 to 75 kg/cm$^2$ and a final (trailing edge) tension of 3 to 75 kg/cm$^2$. Loose winding below this range would allow the roll to undergo sag deformation under gravity during heat treatment. Beyond this range, wrinkles would form due to tightening. More preferably the initial tension is 5 to 40 kg/cm$^2$ and the final tension is 2 to 35 kg/cm$^2$. It is preferred to wind a web into a roll under controlled tension such that the initial tension is greater than the final tension.

In the practice of the invention, the support is preferably fed under a tension of up to 13 kg/cm$^2$, more preferably up to 10 kg/cm$^2$, most preferably up to 4 kg/cm$^2$, during heat treatment because the percent thermal dimensional change of the support is dramatically reduced. As a result, quite unexpectedly, the adhesion of the support and the overlying layer is outstandingly improved.

Preferably the winding core has a diameter of 100 to 600 mm. A smaller diameter would cause wrinkles and depressions to form during heat treatment. With a larger diameter, the resulting roll becomes too bulky and inconvenient for transportation and storage. More preferably, the diameter is 150 to 450 mm, most preferably 200 to 400 mm. The winding core should preferably have an exactly circular cross-section.

Heat development is effected at a sufficient temperature for a sufficient time for development to take place. The developing temperature is usually 80° C. to 250° C., preferably 100° C. to 200° C. The developing time is 1 second to about 2 minutes. The heating procedure is not critical. Any of well-known heating procedures may be used, for example, contacting of the recording element with a hot plate or hot roller as disclosed in WO 95/30934, passage of the recording element through hot air in an oven as disclosed in WO 97/28488, infrared heating, and microwave heating. Alternatively, an electrically resistive material such as carbon black is added to a suitable layer in the recording element whereby heat is generated by electric conduction.

EXAMPLE

Examples of the invention are given below by way of illustration and not by way of limitation.

Tg is a glass transition temperature and Mw is a molecular weight.

Jurimer ET410: acrylic resin water dispersion, Nippon Junyaku K.K.

Sumitex Resin M-3: water-soluble melamine compound, Sumitomo Chemical Industry K.K.

Chemipearl S-120: polyolefin water dispersion, Mitsui Petro-Chemical K.K.

Snowtex C: colloidal silica water dispersion, Nissan Chemical K.K.

Denacol EX614B: epoxy compound, Nagase Chemicals K.K.

LACSTAR 3307B: styrene-butadiene copolymer (SBR) latex having Tg 17° C., a mean particle size of about 0.1 to 0.15 μm, and an equilibrium moisture content at 25° C. and RH 60% of 0.6 wt %, Dai-Nippon Ink & Chemicals K.K.

PVA-205, PVA-215 and PVA-217: polyvinyl alcohol, Kurare K.K.

MP-203: modified polyvinyl alcohol, Kurare K.K.

Sildex H121: spherical silica having a mean size of 12 μm by Dokai Chemical K.K.

Example 1

Preparation of Back-coated Support

The following layers were successively formed on a polyester film of 120 μm thick.

| Coating solution A | |
|---|---|
| Jurimer ET419 (30 wt %) | 32.9 g |
| Gelatin | 6.3 g |
| Compound A | 0.02 g |
| Conductive metal oxide (Sb-doped $SnO_2$) (20 wt % water dispersion) | 83 g |
| Polyoxyethylene phenyl ether | 1 g |
| Sumitex Resin M-3 (8 wt % aqueous solution) | 22 g |
| Dye A | 2.1 g |
| Matte agent (PNMA, mean particle size 5 μm, 10 wt % water dispersion) | 7.3 g |
| Distilled water | to make 1,000 g |

Dye A

-continued

Coating solution A

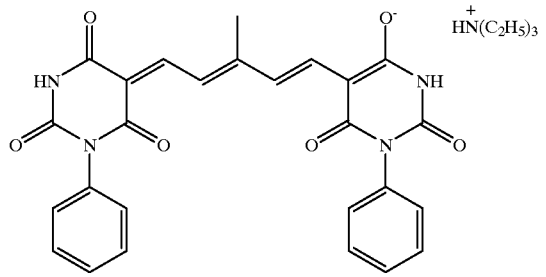

The structural formula of Compound A is given later.

Coating solution A was applied to one surface (back surface) of the support and dried at 180° C. for 30 seconds, forming a first layer of 0.35 μm thick.

| Coating solution B | |
|---|---|
| Chemipearl S-120 (27 wt % water dispersion) | 90 g |
| Snowtex C (30 wt % water dispersion) | 60 g |
| Polystyrene sulfonate (Mw 1000–5000) | 3 g |
| Denacol EX614B (1 wt % aqueous solution) | 90 g |
| Distilled water | 757 g |

Coating solution B was applied onto the first layer and dried at 170° C. for 30 seconds, forming a second layer of 0.25 μm thick. A back-coated support was prepared in this way.

A subbing layer for bearing an image-recording layer was then formed on the other surface of the support.

| | |
|---|---|
| Jurimer ET410 (30 wt % water dispersion) | 32.9 g |
| Polyoxyethylene phenyl ether | 1 g |
| Sumitex Resin M-3 (8% aqueous solution) | 22 g |
| Colloidal silica (20 wt % water dispersion) | 10 g |

This solution was applied and dried at 180° C. for 30 seconds, forming a subbing layer of 0.20 μm thick.

The thus prepared support was passed through a heat treating zone having an overall length of 200 m and set at 150° C. at a feed speed of 20 m/min under a tension of 3 kg/m$^2$. Thereafter, the support was passed through a zone set at 40° C. for 15 seconds and taken up into a roll under a tension of 10 kg/cm$^2$.

Thermographic Recording Layer (Emulsion Layer)

Silver halide emulsion A

In 700 ml of water were dissolved 11 g of phthalated gelatin, 30 mg of potassium bromide, and 10 mg of sodium benzenethiosulfonate. The solution was adjusted to pH 5.0 at a temperature of 55° C. To the solution, 159 ml of an aqueous solution containing 18.6 g of silver nitrate and an aqueous solution containing 1 mol/liter of potassium bromide were added over 6½ minutes by the controlled double jet method while maintaining the solution at pAg 7.7. Then, 476 ml of an aqueous solution containing 55.5 g of silver nitrate and an aqueous solution containing 1 mol/liter of potassium bromide were added over 28½ minutes by the controlled double jet method while maintaining the solution at pAg 7.7. Thereafter, the pH of the solution was lowered to cause flocculation and sedimentation for desalting.

Further, 0.17 g of Compound A and 23.7 g of deionized gelatin (calcium content below 20 ppm) were added to the solution, which was adjusted to pH 5.9 and pAg 8.0. There were obtained cubic grains of silver halide having a mean grain size of 0.11 μm, a coefficient of variation of the projected area of 8%, and a (100) face proportion of 93%.

The thus obtained silver halide grains were heated at 60° C., to which 76 μmol of sodium benzenethiosulfate was added per mol of silver. After 3 minutes, 154 μmol of sodium thiosulfate was added and the emulsion was ripened for 100 minutes.

Thereafter, the emulsion was maintained at 40° C., and with stirring, $6.4\times10^{-4}$ mol of Sensitizing Dye A and $6.4\times10^{-3}$ mol of Compound B were added per mol of silver halide. After 20 minutes, the emulsion was quenched to 30° C., completing the preparation of a silver halide emulsion A.

dispersion were acicular grains having a mean minor axis (or breadth) of 0.04 μm, a mean major axis (or length) of 0.8 μm, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Solid particle dispersion of 1,1-bis(2-hydroxy-3,5-dimethylphenyl)-3,5,5-trimethylhexane To 20 g of 1,1-bis(2-hydroxy-3,5-dimethylphenyl)-3,5,5-trimethylhexane were added 3.0 g of polyvinyl alcohol MP-203 and 77 ml of water. They were thoroughly agitated to form a slurry, which was allowed to stand for 3 hours. A vessel was charged with the slurry together with 360 g of zirconia beads having a mean diameter of 0.5 mm. A Sensitizing Dye A

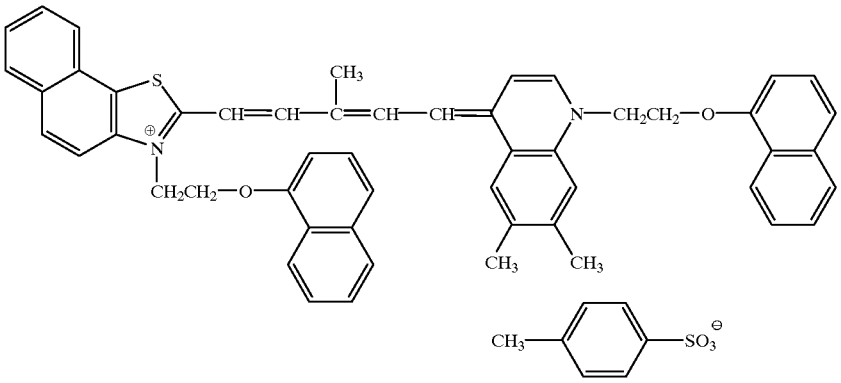

Compound A

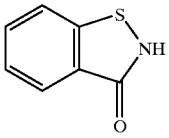

Compound B

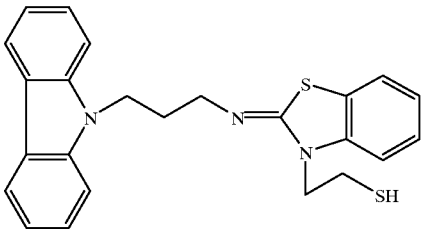

Organic acid silver dispersion

While a mixture of 4.4 g of arachic acid, 39.4 g of behenic acid, and 770 ml of distilled water was stirred at 85° C., 103 ml of 1N NaOH aqueous solution was added over 60 minutes. Reaction was carried out for 240 minutes. The solution was cooled to 75° C. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 μS/cm. The thus obtained solids were handled as a wet cake without drying. To 100 g as dry solids of the wet cake, 5 g of polyvinyl alcohol PVA-205 and water were added to a total weight of 500 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained an organic acid silver dispersion A. The organic acid silver grains in this dispersing machine 1/4G Sand Grinder Mill (Imex K.K.) was operated for 3 hours for dispersion, obtaining a solid particle dispersion of the reducing agent. The mean particle size was 0.65 μm, and particles with a diameter of 0.3 to 1.0 μm accounted for 80% by volume.

Solid particle dispersion of tribromomethylphenylsulfone

To 30 g of tribromomethylphenylsulfone were added 0.5 g of hydroxypropylmethyl cellulose, 0.5 g of Compound C, and 88.5 g of water. They were thoroughly agitated to form a slurry, which was allowed to stand for 3 hours. Following the steps used in the preparation of the solid particle dispersion of the reducing agent, a solid particle dispersion of the antifoggant was prepared. The mean particle size was 0.63 μm, and particles with a diameter of 0.3 to 1.0 μm accounted for 80% by volume.

Emulsion layer coating solution

To the above-prepared organic acid silver grain dispersion (corresponding to 1 mol of silver) were added the above-prepared silver halide emulsion A and the binder and addenda described below. Water was added thereto to form an emulsion layer coating solution.

| | |
|---|---|
| LACSTAR 3307B (SBR latex) | as solids 470 g |
| 1,1-bis(2-hydroxy-3,5-dimethylphenyl)-3,5,5-trimethylhexane | as solids 110 g |
| Tribromomethylphenylsulfone | as solids 12.4 g |
| Sodium benzenethiosulfonate | 0.25 g |
| Polyvinyl alcohol MP-203 | 46 g |
| 6-Isobutylphthalazine | 0.12 mol |
| Nucleating agent A | 0.9 g |
| Nucleating agent B | 0.9 g |
| Dye A | 0.62 g |
| Silver halide emulsion A | as Ag 0.05 mol |

Compound C

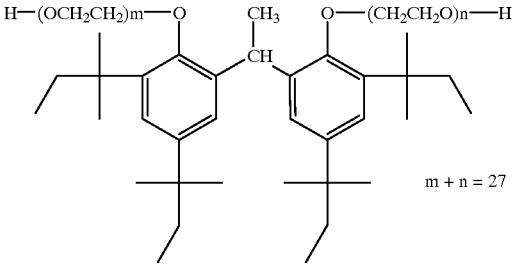

Nucleating agent A

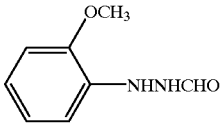

Nucleating agent B

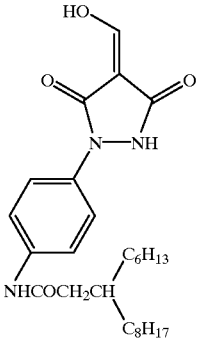

Emulsion surface protective layer coating solution

A surface protective layer coating solution was prepared by adding 3.75 g of $H_2O$ to 109 g of a polymer latex having a solids content of 27.5% (methyl methacrylate/styrene/2-ethylhexyl acrylate/2-hydroxyethyl methacrylate/methacrylic acid=59/9/26/5/1 copolymer, Tg 55° C.), then adding 4.5 g of benzyl alcohol as a film-forming aid, 0.45 g of Compound D, 0.125 g of Compound E, 0.0125 mol of Compound F, and 0.225 g of polyvinyl alcohol PVA-217, and diluting with water to a total weight of 150 g.

Compound D

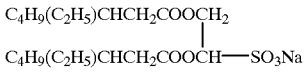

-continued

Compound E

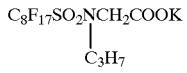

Compound F

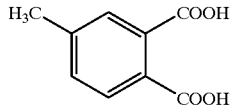

Preparation of Thermographic Image-recording Element (Comparative Sample A)

The emulsion layer coating solution was applied onto the subbing layer on the support so as to give a silver coverage of 1.6 g/m$^2$. Further, the emulsion surface protective layer coating solution was applied thereon so as to give a coverage of 2.0 g/m$^2$ of polymer latex solids. Comparative Sample A was obtained in this way.

Preparation of Inventive Samples

Compound I-4 was used as a typical compound of formula (I) according to the invention.

Inventive Sample 1-1 was prepared by the same procedure as Comparative Sample A except that Compound I-4 was added to the emulsion coating solution in such an amount as to give a coverage of 7.0 mg/m$^2$ of the compound.

Inventive Sample 1-2 was prepared by the same procedure as Comparative Sample A except that Compound I-4 was added to the solid particle dispersion of 1,1-bis(2-hydroxy-3,5-dimethylphenyl)-3,5,5-trimethylhexane during its preparation in such an amount as to give a coverage of 7.0 mg/m$^2$ of the compound. Bubble formation during preparation of the dispersion of the reducing agent was suppressed so that the dispersion could be smoothly taken out of the vessel at the end of dispersing operation. The dispersion's mean particle size was 0.45 $\mu$m, and particles with a diameter of 0.3 to 1.0 $\mu$m accounted for 90% by volume. To distinguish from the original dispersion, this dispersion is designated inventive dispersion.

The original and inventive dispersions were passed through a filter with a mesh size of 3 $\mu$m. The original dispersion caused immediate filter clogging whereas the inventive dispersion caused no clogging.

Inventive Sample 1-3 was prepared by the same procedure as Comparative Sample A except that Compound I-4 was added to the solid particle dispersion of tribromomethylphenylsulfone during its preparation in such an amount as to give a coverage of 7.0 mg/m$^2$ of the compound. Few bubbles formed during preparation of the dispersion of the antifoggant so that the fine dispersion could be smoothly taken out of the vessel at the end of dispersing operation. The dispersion's mean particle size was 0.33 $\mu$m, and particles with a diameter of 0.3 to 1.0 $\mu$m accounted for 90% by volume. Passage of this dispersion through a filter with a mesh size of 3 $\mu$m caused no pressure loss.

Photographic Test

These samples were subjected to sensitometry. Exposure was made using a Xe light source with a 780-nm interference filter. The samples on their back side were then brought in pressure contact with a hot plate for heat development. Development was carried out at different temperatures for a fixed time of 25 seconds. The photographic properties examined are a fog density (fog), a maximum density (Dmax), and a gradation (G) which is the gradient of a straight line connecting points of density 0.3 and 3.0 on the characteristic curve.

The results are shown in Table 1.

TABLE 1

| Sample No. | Photographic properties | Developing temperature 110° C. | 112° C. | 114° C. | 116° C. |
|---|---|---|---|---|---|
| A | fog | 0.11 | 0.14 | 0.16 | 0.23 |
| | Dmax | 2.77 | 3.80 | 4.12 | 4.55 |
| | $\overline{G}$ | — | 12.9 | 14.5 | 18.2 |
| 1-1 | fog | 0.14 | 0.16 | 0.18 | 0.21 |
| | Dmax | 3.71 | 4.27 | 4.55 | 4.58 |
| | $\overline{G}$ | 14.2 | 18.1 | 20.3 | 20.8 |
| 1-2 | fog | 0.15 | 0.16 | 0.18 | 0.20 |
| | Dmax | 4.03 | 4.45 | 4.78 | 4.84 |
| | $\overline{G}$ | 14.7 | 18.8 | 20.7 | 22.3 |
| 1-3 | fog | 0.10 | 0.13 | 0.15 | 0.17 |
| | Dmax | 3.50 | 4.08 | 4.28 | 4.59 |
| | $\overline{G}$ | 12.3 | 15.1 | 17.2 | 20.5 |

As is evident from Table 1, the inventive samples show high Dmax and high contrast. The photographic properties of Comparative Sample A as developed at 114° C. were achieved with the inventive samples at 110 to 112° C. The developing temperature is lowered by 2 to 4° C.

Inventive Sample 1-3 shows low fog at all the developing temperatures.

Example 2

Samples were prepared and tested as in Example 1 except that Compounds I-1, I-3 and I-14 were used instead of Compound I-4 as the compound of formula (I). Samples within the scope of the invention showed favorable properties as in Example 1.

Example 3

Coated samples were prepared as follows.

Organic silver dispersion B

While a mixture of 40 g of behenic acid, 7.3 g of stearic acid, and 500 ml of distilled water was stirred for 15 minutes at 90° C., 187 ml of 1N NaOH aqueous solution was added over 15 minutes. Then 61 ml of a 1N nitric acid aqueous solution was added to the solution, which was cooled to 50° C. Next, 124 ml of a 1N silver nitrate aqueous solution was added over 2 minutes to the solution, which was stirred at the temperature for 30 minutes. Thereafter, the solids were separated by suction filtration and washed with water until the water filtrate reached a conductivity of 30 $\mu$S/cm. The thus obtained solids were handled as a wet cake without drying. To 100 g as dry solids of the wet cake, 10 g of polyvinyl alcohol PVA-205 and water were added to a total weight of 500 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained an organic acid silver dispersion B. The organic acid silver grains in this dispersion had a volume weighed mean diameter of 0.93 $\mu$m as measured by Master Sizer X (Malvern Instruments Ltd.).

Silver halide grains B

In 700 ml of water were dissolved 22 g of phthalated gelatin and 30 mg of potassium bromide. The solution was adjusted to pH 5.0 at a temperature of 40° C. To the solution, 159 ml of an aqueous solution containing 18.6 g of silver nitrate and an aqueous solution containing potassium bromide were added over 10 minutes by the controlled double jet method while maintaining the solution at pAg 7.7. Then, 476 ml of an aqueous solution containing 55.4 g of silver nitrate and an aqueous solution containing 8 $\mu$mol/liter of dipotassium hexachloroiridate and 1 mol/liter of potassium bromide were added over 30 minutes by the controlled double jet method while maintaining the solution at pAg 7.7. Thereafter, the pH of the solution was lowered to cause flocculation and sedimentation for desalting. Further, 0.1 g of phenoxyethanol was added to the solution, which was adjusted to pH 5.9 and pAg 8.0. There were obtained cubic grains of silver halide having a mean grain size of 0.07 $\mu$m, a coefficient of variation of the projected area diameter of 8%, and a (100) face proportion of 86%.

The thus obtained silver halide grains B were heated at 60° C., to which 85 $\mu$mol of sodium thiosulfate, 11 $\mu$mol of 2,3,4,5,6-pentafluorophenyldiphenyl phosphine selenide, 2 $\mu$mol of Tellurium Compound 1, 3.3 $\mu$mol of chloroauric acid, and 230 $\mu$mol of thiocyanic acid were added per mol of silver. The emulsion was ripened for 120 minutes.

Thereafter, the emulsion was cooled to 40° C. With stirring, $3.5\times10^{-4}$ mol of Sensitizing Dye B was added and after 5 minutes, $4.6\times10^{-3}$ mol of Compound G was added, both per mol of silver halide. After 5 minutes of stirring, the emulsion was quenched to 25° C., completing the preparation of silver halide grains B.

Tellurium Compound 1

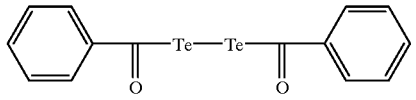

Sensitizing Dye B

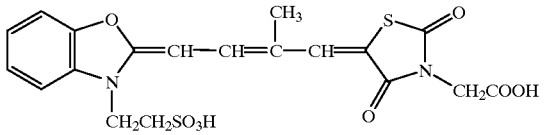

Compound G

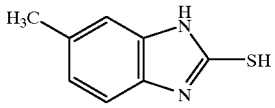

Solid particle dispersions of addenda

The dispersions prepared in Example 1 were used.

Solid particle dispersion of dyed polymer

A mixture containing 2 g of Dye B, 6 g of a methyl methacrylate-methacrylic acid copolymer (85:15), and 40 ml of ethyl acetate was heated at 60° C. for dissolution. To the solution was added 100 ml of an aqueous solution containing 5 g of polyvinyl alcohol. The mixture was finely dispersed for 5 minutes by means of a high-speed homogenizer (Nippon Seiki Mfg. K.K.) at 12,000 rpm, obtaining an emulsified dispersion P of fine polymeric particles.

Dye B

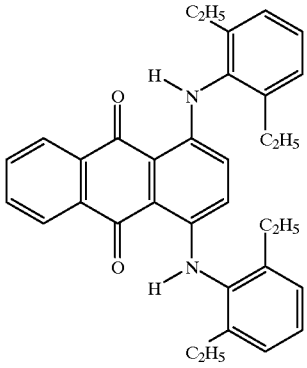

Emulsion layer coating solution

To the above-prepared organic acid silver grain dispersion B (corresponding to 1 mol of silver) were added the above-prepared silver halide emulsion B (in an amount corresponding to 10 mol % of silver halide based on organic acid silver) and the binder and developing addenda described below. Water was added thereto to form an emulsion layer coating solution.

| | | |
|---|---|---|
| Binder: | | |
| LACSTAR 3307B (SBR latex) | | 430 g |
| Developing addenda: | | |
| Tetrachlorophthalic acid | | 5 g |
| 1,1-bis(2-hydroxy-3,5-dimethylphenyl)-3,5,5-trimethylhexane | as solids | 98 g |
| Phthalazine | | 9.2 g |
| Tribromomethylphenylsulfone | as solids | 12 g |
| 4-Methylphthalic acid | | 7 g |
| Dye: | | |
| Particle dispersion of dyed polymer | | 4 g (Dye B) |

Emulsion surface protective layer coating solution

A surface protective layer coating solution was prepared by adding 0.26 g of Surfactant A, 0.09 g of Surfactant B, 0.9 g of silica fine particles having a mean particle size of 2.5 μm, 0.3 g of 1,2-bis(vinylsulfonyl-acetamide)ethane, and 64 g of water to 10 g of inert gelatin.

Surfactant A

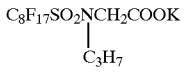

Surfactant B

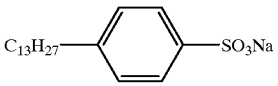

Dispersion of dye

Dye C, 0.8 g, was added to 35 g of ethyl acetate and dissolved therein by agitation. This was combined with 85 g of a 6 wt % aqueous solution of polyvinyl alcohol PVA-217 and agitated for 5 minutes by a homogenizer. After the ethyl acetate was volatilized off by solvent removal, the residue was diluted with water, obtaining a dye dispersion.

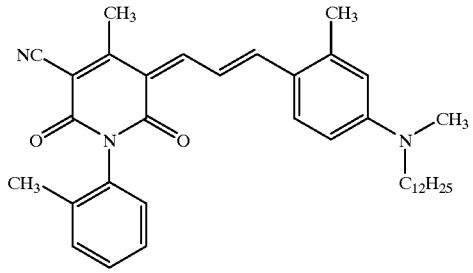

Solid particle dispersion of base

To 26 of a solid base shown below was added 234 g of an aqueous solution containing 2 g of polyvinyl alcohol PVA-215. They were thoroughly agitated into a slurry, which was allowed to stand for 10 hours. A vessel was charged with the slurry together with 100 ml of zirconia beads having a mean diameter of 0.5 mm. A dispersing machine 1/4G Sand Grinder Mill (Imex K.K.) was operated for 5 hours for dispersion, obtaining a solid particle dispersion of the base.

Solid Base

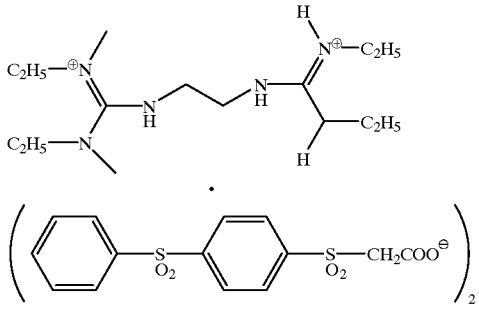

Back side coating solution

A back side coating solution was prepared by adding 20 g of the dye dispersion, 20 g of the solid base particle dispersion and 35 g of water to 38 g of a 10% gelatin solution.

Back surface protective layer coating solution

A back surface protective layer coating solution was prepared by adding 0.26 g of Surfactant A, 0.09 g of Surfactant B, 0.3 g of 1,2-bis(vinylsulfonyl-acetamide) ethane, 0.4 g of spherical silica Sildex H121 (mean size 12 μm), and 64 g of water to 10 g of inert gelatin.

Coated samples

The emulsion layer coating solution was applied onto one surface of a PET support of 175 μm thick so as to give a coverage of 2.2 g/m$^2$ of silver. Further, the emulsion surface protective layer coating solution was applied thereon so as to give a coverage of 1.8 g/m$^2$ of gelatin. After drying, the back side coating solution was applied onto the back surface of the support so as to give a coverage of 56 mg/m$^2$ of Dye B. Further, the back surface protective layer coating solution was applied onto the back layer so as to give a coverage of 1.8 g/m$^2$ of gelatin. Sample B was obtained in this way. Sample B was a comparative sample since the solid dispersions used in preparing Sample B were free of the compound of formula (I).

Inventive Sample 3-2 was prepared by the same procedure as Comparative Sample B except that Compound I-4 was added to the solid particle dispersion of 1,1-bis(2-hydroxy-3,5-dimethylphenyl)-3,5,5-trimethylhexane during its preparation in the same amount as in Sample 1-2 of Example 1.

Inventive Sample 3-3 was prepared by the same procedure as Comparative Sample B except that Compound I-4 was added to the solid particle dispersion of tribromomethylphenylsulfone during its preparation in the same amount as in Sample 1-3 of Example 1.

Photographic Test

After these samples were exposed using a laser sensitometer with a 660-nm diode, they were heat developed as in Example 1. $S_{0.3}$ is a logarithmic value of an exposure providing a density of 0.3 and expressed in relative value provided that the $S_{0.3}$ of Sample B developed at 120° C. is 0.

The results are shown in Table 2.

TABLE 2

| Sample No. | Photographic properties | Developing temperature 116° C. | 118° C. | 120° C. | 122° C. |
|---|---|---|---|---|---|
| B | fog | 0.13 | 0.17 | 0.19 | 0.24 |
| | $S_{0.3}$ | −0.31 | −0.18 | 0 | +0.27 |
| 3-2 | fog | 0.18 | 0.19 | 0.23 | — |
| | $S_{0.3}$ | −0.10 | +0.05 | +0.29 | — |
| 3-3 | fog | 0.13 | 0.17 | 0.18 | 0.19 |
| | $S_{0.3}$ | −0.15 | −0.02 | +0.15 | +0.22 |

As is evident from Table 2, the inventive samples achieve equivalent properties to the comparative samples even when the developing temperature is 2 to 4° C. lower.

There has been described a thermographic image-recording element comprising a thermoplastic polymer binder and a compound of formula (I). The developing temperature ensuring satisfactory photographic properties becomes lower.

Japanese Patent Application No. 112722/1998 is incorporated herein by reference.

Reasonable modifications and variations are possible from the foregoing disclosure without departing from either the spirit or scope of the present invention as defined by the claims.

What is claimed is:

1. A thermographic image-recording element comprising on a support an image-recording layer containing a non-photosensitive organic silver salt, a reducing agent capable of reducing the organic silver salt added to the image-recording layer as a solid dispersion in water, and a thermoplastic polymer binder, said element further comprising a compound of the following formula (I):

$$A_1—C≡C—A_2 \quad (I)$$

wherein $A_1$ and $A_2$ may be the same or different and represent hydrogen, alkyl groups having up to 16 carbon atoms in total, or aromatic ring groups, at least one of $A_1$ and $A_2$ is an alkyl group of up to 16 carbon atoms in total having a hydroxyl group as a substituent, or an aryl group.

2. The thermographic image-recording element of claim 1 further comprising a photosensitive silver halide.

3. The thermographic image-recording element of claim 1 further comprising an ultrahigh contrast promoting agent.

4. The thermographic image-recording element of claim 1 wherein said binder comprises a water-dispersed latex of the thermoplastic polymer.

5. The thermographic image-recording element of claim 4 further comprising an antifoggant, the antifoggant having been added as a solid dispersion thereof in water.

6. The thermographic image-recording element of claim 1, wherein one or both of $A_1$ and $A_2$ are alkyl groups having 10 or less carbon atoms in total.

7. The thermographic image-recording element of claim 1, wherein the compound of formula (I) is a compound selected from the group consisting of:

I-1

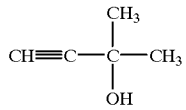

I-2

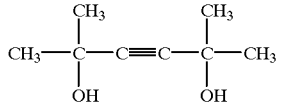

I-3

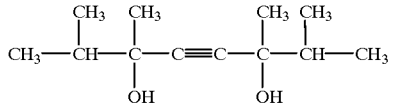

I-4

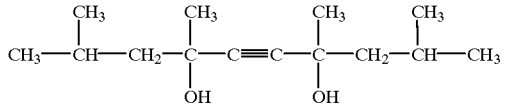

I-5

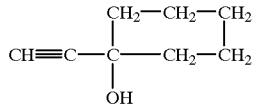

I-6

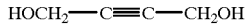

I-7

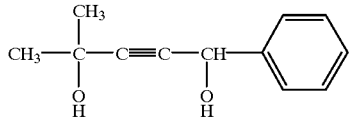

I-8

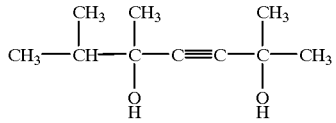

I-9

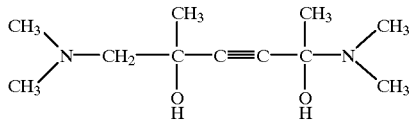

I-10

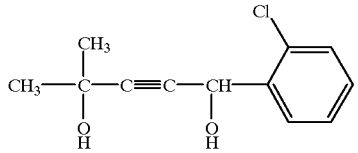

I-11

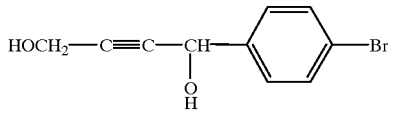

-continued

I-12

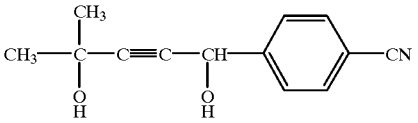

I-13

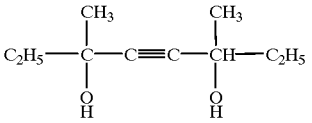

I-14

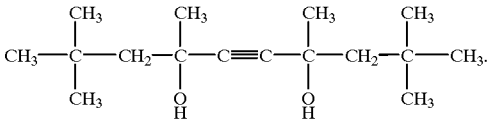

8. The thermographic image-recording element of claim 1, wherein the compound of formula (I) is used in a amount of 0.05 to 500 mg/m$^2$.

9. The thermographic image-recording element of claim 1, wherein the reducing agent is selected from the group consisting of amidoximes; azines; combinations of aliphatic carboxylic acid arylhydrazides with ascorbic acid; combinations of polyhydroxybenzenes with hydroxylamine, reductone and/or hyrdrazine; hydroxamic acids; combinations of azines with sulfonamidophenols; α-cyanophenyl acetic acid derivatives; bis-β-naphthols; combinations of bis-β-naphthols with 1,3-dihydroxybenzene derivatives; 5-pyrazolones; reductones; sulfonamidephenol reducing agents; 2-phenylindane-1,3-dione; chromans; 1,4-dihydropyridines; bisphenols; ascorbic acid derivatives; aldehydes; ketones; 3-pyrazolindones; and indane-1,3-diones.

* * * * *